US007583927B2

(12) United States Patent
Takahashi et al.

(10) Patent No.: US 7,583,927 B2
(45) Date of Patent: Sep. 1, 2009

(54) IMAGE FORMING APPARATUS

(75) Inventors: Atsushi Takahashi, Akishima (JP); Utami Soma, Hachioji (JP); Youbao Peng, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 264 days.

(21) Appl. No.: 11/581,554

(22) Filed: Oct. 16, 2006

(65) Prior Publication Data

US 2007/0242997 A1 Oct. 18, 2007

(30) Foreign Application Priority Data

Apr. 14, 2006 (JP) ..... 2006-112719

(51) Int. Cl.
*G03G 15/00* (2006.01)
*B65H 9/16* (2006.01)

(52) U.S. Cl. ..... 399/395; 399/401; 399/364; 399/306; 271/248

(58) Field of Classification Search ..... 399/306, 399/364; 271/248
See application file for complete search history.

(56) References Cited

U.S. PATENT DOCUMENTS 4,602,778 A * 7/1986 Hirose et al. ..... 271/227
6,249,334 B1 6/2001 Ui et al.
2002/0181021 A1 12/2002 Stephens
2006/0051145 A1 * 3/2006 Ubayashi ..... 399/395

FOREIGN PATENT DOCUMENTS

| | | | |
|---|---|---|---|
| EP | 1 002 652 | A2 | 5/2000 |
| JP | 10-319674 | A | 12/1998 |
| JP | 2003-156974 | A | 5/2003 |
| JP | 2004-271926 | A | 9/2004 |
| JP | 2005-263463 | A | 9/2005 |
| JP | 2006-082469 | A | 3/2006 |

OTHER PUBLICATIONS

Japanese Office Action dated Aug. 19, 2008 and English translation thereof issued in counterpart Japanese Appln. No. 2006-112719.
English language translation of Japanese Office Action dated Aug. 19, 2008, issued in a counterpart Japanese Application.

* cited by examiner

*Primary Examiner*—Daniel J Colilla
*Assistant Examiner*—Allister Primo
(74) *Attorney, Agent, or Firm*—Frishauf, Holtz, Goodman & Chick, P.C.

(57) ABSTRACT

An image forming apparatus that forms an image on a surface of a transfer sheet, then, reverses the transfer sheet on which the image has been formed on the surface and then, forms an image on the reverse side of the transfer sheet, wherein there is provided a correcting section that changes a relative position between the transfer sheet and the image on the surface in accordance with an outer shape of the transfer sheet and further changes a relative position between the transfer sheet and the image on the reverse side of the transfer sheet in accordance with an outer shape of the transfer sheet.

8 Claims, 19 Drawing Sheets

IMAGE FORMING APPARATUS

This application is based on Japanese Patent Application No. 2006-112719 filed on Apr. 14, 2006, the entire content of which is hereby incorporated by reference.

BACKGROUND OF THE INVENTION

The present invention relates to an image forming apparatus such as a copying machine or a printer, and in particular, to an image forming apparatus capable of forming images on both sides of a sheet.

The image forming apparatus such as a copying machine or a printer is equipped with an image carrier, an image writing section, a developing unit, a sheet-feeding tray, a transfer section and a fixing section. Now, the constitution of the image forming apparatus will be explained as follows, referring to FIG. 18 which is a cross-sectional view showing the constitution of the image forming apparatus.

Automatic conveyance device 10 is a device to conduct conveyance for reading a document. A plurality of documents d each being under the condition that the front surface of the first page of the document faces upward are loaded on document loading section 11 which is for loading documents. Document d is fed out through roller 12*a* and roller 12*b*, and is conveyed to image reading section 20 through roller 13. Then, the document d whose images have been read in the image reading section 20 is reversed by reversing roller 14, to be ejected on sheet ejection tray 16 with its front surface facing downward.

The image reading section 20 scans the document optically to generate image data. An image surface of the document d is illuminated by light source 23, and its reflected light forms an image on a light-receiving surface of CCD 28 representing a photoelectric conversion means, through mirror 24, mirror 25, mirror 26 and combined optical system 27. Incidentally, when reading the document d by placing it on platen glass 21 so that the surface of the document d to be read may face downward, the optical system is moved along the platen glass 21 for the reading operation. Further, when reading the document d, while conveying it, the reading operation is conducted under the condition the light source 23 and the mirror 24 are fixed on second platen glass 22. Image data of the document d that has been read are sent to an image processing section (not shown) from CCD 28. In the mean time, when the document d is conveyed for its both sides by automatic conveyance device 10, the document d is reversed and conveyed to roller 13 again through reversing roller 14 after the front surface of the document d has been read, whereby, the rear surface of the document d is read by image reading section 20, and image data obtained through the reading are sent to an image processing section from CCD 28.

Transfer sheets P are loaded on sheet-feeding tray 30. Incidentally, though a single step of sheet-feeding tray 30 is provided in the structure in FIG. 18, it is normal that a plurality of sheet-feeding trays are provided so that transfer sheets having different sizes may be loaded.

Sheet supply section 40 supplies transfer sheets P to image forming section 60 from sheet-feeding tray 30. Transfer sheet P is fed out of the sheet-feeding tray 30 by conveyance roller 41, and is caused to hit a nip portion of a registration roller 43 through loop rollers 42 to be stopped temporarily, thereby, a skew of the transfer sheet P is corrected. Then, the transfer sheet P is conveyed to photoreceptor drum 61 of the image forming section 60 at prescribed timing. Further, the transfer sheet P is fed out of manual feed tray 31 by conveyance roller 41, and is conveyed to photoreceptor drum 61 of the image forming section 60 through the same process flow as in the foregoing.

Image writing section 50 is composed of a polygon mirror (not shown) that deflects a laser beam emitted from laser element 51 based on inputted image data. The deflected laser beam is caused by the polygon mirror to scan and is projected on photoreceptor drum 61 through a mirror. Owing to this, an electrostatic latent image is formed on the photoreceptor drum 61.

The image forming section 60 records the electrostatic latent image formed on the photoreceptor drum 61 on transfer sheet P through an electrophotographic system. First, when a laser beam emitted from laser diode 51 of the image writing section 50 is irradiated on the photoreceptor drum 61 charged evenly by charging section 67, an electrostatic latent image is formed. Then the electrostatic latent image formed on the photoreceptor drum 61 is developed by developing unit 62 to form a toner image on the photoreceptor drum 61. This toner image is transferred onto transfer sheet P by transfer section 63 that is provided below the photoreceptor drum 61. Then, transfer sheet P that is in contact with the photoreceptor drum 61 is separated by separating section 64. The transfer sheet P separated from the photoreceptor drum 61 is conveyed to fixing section 70 by conveyance mechanism 65.

The fixing section 70 fixes a toner image transferred onto transfer sheet P through heat and pressure. The toner image transferred onto transfer sheet P is fixed by heat and pressure exerted from fixing roller 71.

Sheet ejection section 80 ejects transfer sheet P on which the image has been fixed. Transfer sheet P on which the image has been fixed is ejected to sheet ejection tray 82 by sheet ejection roller 81. When forming images on both sides, transfer sheet P is conveyed downward by guide 83, after the image formed on the front surface is fixed, and the transfer sheet P is sent to reversing path 84. The transfer sheet P having entered the reversing path 84 is conveyed to reversing conveyance path 86 by reversing conveyance roller 85. The transfer sheet P having entered the reversing conveyance path 86 is conveyed again to image forming section 60 through sheet supply section 40.

Transfer sheet P is caused to hit a nip portion of the registration roller 43 through loop rollers 42 to be stopped temporarily, thereby, a skew of the transfer sheet P is corrected. Then, the transfer sheet P is conveyed to photoreceptor drum 61 of the image forming section 60 at prescribed timing.

On the image forming section 60, residual toner sticking to the image forming section 60 is removed by cleaning section 66, to be ready for the succeeding image forming. Under this condition, the transfer sheet P is conveyed to image forming section 60, and an image is formed on the other surface (rear surface). Then, the transfer sheet P separated from the photoreceptor drum 61 in the separation section 64 is sent again to fixing section 70 through conveyance mechanism 65 to be fixed. In this way, transfer sheet P on which image fixing on each of the front surface and the rear surface has been terminated is ejected to sheet ejection tray 82 by sheet ejection roller 81.

As stated above, the skew of a transfer sheet for the conveyance direction has been corrected by the registration roller 43 before image forming. With respect to the correction of the skew, there has been proposed a method wherein a pattern for measurement is written on the transfer sheet, then, the position of the pattern is detected to detect the positional shifting and the skew of the transfer sheet, and a position of an image to be formed on the reverse side is determined based on the results of the detection (for example, Patent Document 1).

As another method, there has been proposed a method wherein a mark is written on the surface of a transfer sheet, and when forming an image on the reverse side, a position of the mark is detected, then, a position of an image to be formed on the reverse side of the transfer sheet is determined based on the position of the mark detected and the position of the mark at the point of time when the mark was written, and further, the magnification of the image to be formed on the reverse side is changed (for example, Patent Document 2).

Further, as another method, there has been proposed a method wherein changes in outer dimensions of the transfer sheet generated when the image formed on the surface is fixed are obtained and thereby, the magnification of an image to be formed on the reverse side is changed (for example, Patent Document 3).

(Patent Document 1) JP-A No. 10-319674 (Hereinafter, JP-A refers to Japanese Patent Publication Open to Public Inspection)

(Patent Document 2) JP-A No. 2003-156974

(Patent Document 3) JP-A No. 2004-271926

However, actual transfer sheet P has no orthogonality, and corner angles fluctuate, depending on how sheets are cut. As shown in FIG. 19 (*a*), for example, an angle of a certain corner of transfer sheet P is different, and it is 89° for a certain corner and is 91° for another corner. If an angle of transfer sheet P fluctuates as stated above, there is sometimes an occasion where an image formed on the surface and an image formed on the reverse side do not agree in terms of position each other, even when a skew of transfer sheet P is corrected by the registration roller 43.

When forming an image on the front surface of transfer sheet P, for example, a side in the conveyance direction (a leading edge) of transfer sheet P is caused to hit a nip portion of the registration roller 43 so that a skew of the transfer sheet P for the conveyance direction is corrected, and after that, an image is formed on the surface of image forming section 30. After the image is formed on the surface, when an image is formed on a reverse side of the transfer sheet P, the transfer sheet P is reversed by reversing path 84, reversing and conveying roller 85 and reversing and conveying path 86, and is sent again to image forming section 6. Since the transfer sheet P is reversed as stated above, a side of transfer sheet P opposite to the leading edge (a trailing edge) is caused to hit a nip portion of the registration roller 43 as shown in FIG. 19 (*c*), and a skew of the transfer sheet P for the conveyance direction is corrected. After that, an image is formed on the reverse side by the image forming section 60.

However, since a skew angle of the leading edge is different from that of a side opposite to the leading edge (a trailing edge) in transfer sheet P as shown in FIG. 19 (*a*), an image formed on the surface is deviated from an image formed on the reverse side by the difference equivalent to the difference of the angle as shown in FIG. 19 (*c*), and it has been difficult to align an image on the surface with an image on the reverse side highly accurately. In other words, since transfer sheet P has no orthogonality with its each side skewing, even when different sides are caused to hit the registration roller 43 for correcting skews, the skew of transfer sheet P for conveyance direction before transferring images onto the surface is different from that before transferring images onto the reverse side. As a result, a position of the image on the surface is shifted from that of the image on the reverse side, resulting in difficulties of aligning images highly accurately.

SUMMARY OF THE INVENTION

The problems mentioned above are solved by the present invention, and its object is to provide an image forming apparatus wherein, when forming images on both sides of a transfer sheet, images formed on both sides can be aligned highly accurately.

An embodiment of the invention is an image forming apparatus that forms an image on a surface of a transfer sheet, then, reverses the transfer sheet on which the image has been formed on the surface and then, forms an image on the reverse side of the transfer sheet, wherein there is provided a correcting section that changes a relative position between the transfer sheet and the image on the surface in accordance with an outer shape of the transfer sheet and further changes a relative position between the transfer sheet and the image on the reverse side of the transfer sheet in accordance with an outer shape of the transfer sheet.

DETAILED DESCRIPTION OF THE INVENTION

First Embodiment (Structure)

Figure 1:
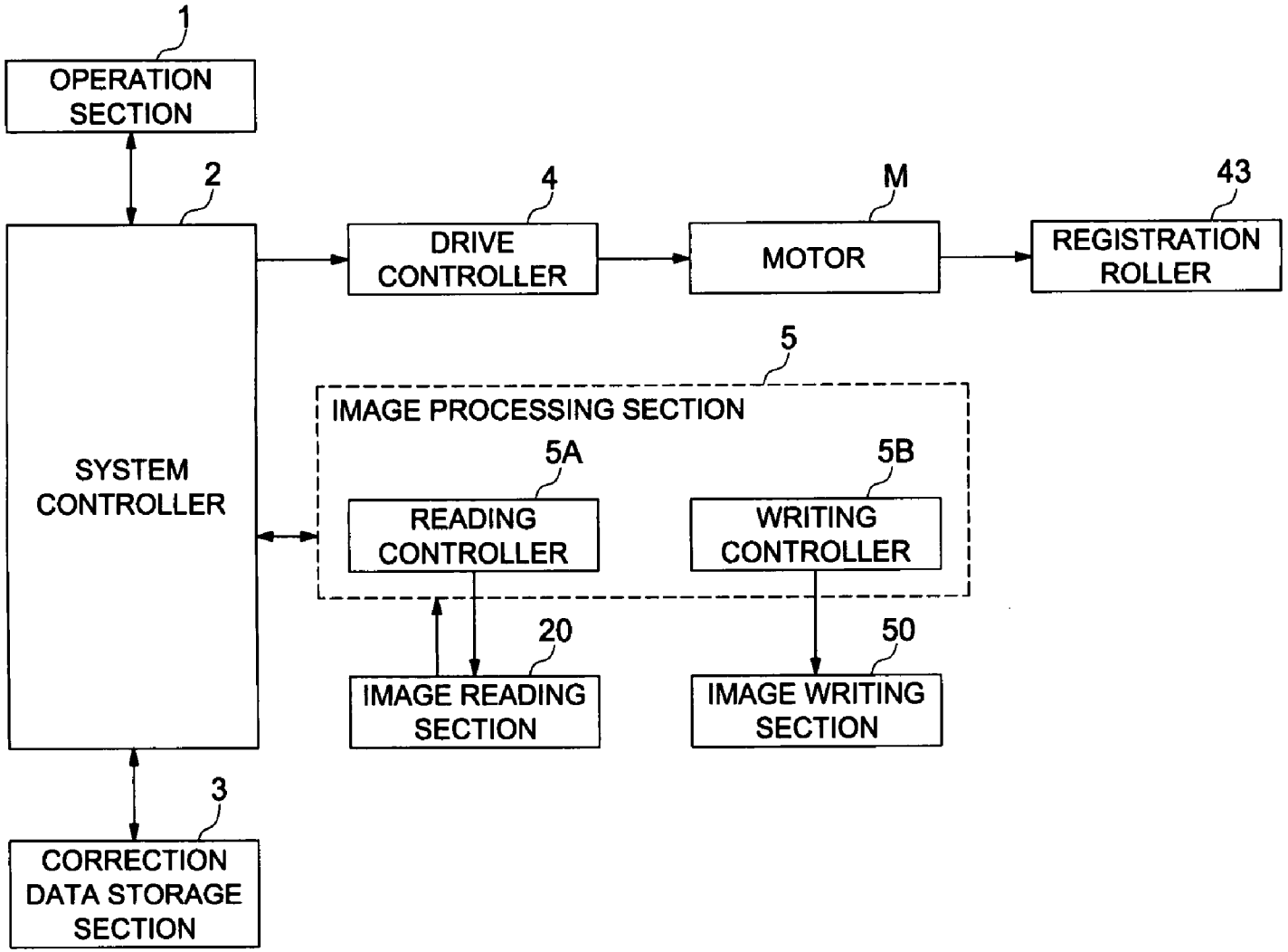
FIG. 1 is a block diagram showing a constitution of an image forming apparatus relating to the first embodiment of the invention.

A structure of an image forming apparatus relating to the first embodiment of the invention will be explained as follows, referring to FIG. 1 which is a block diagram showing a constitution of an image forming apparatus relating to the first embodiment of the invention.

Figure 18:
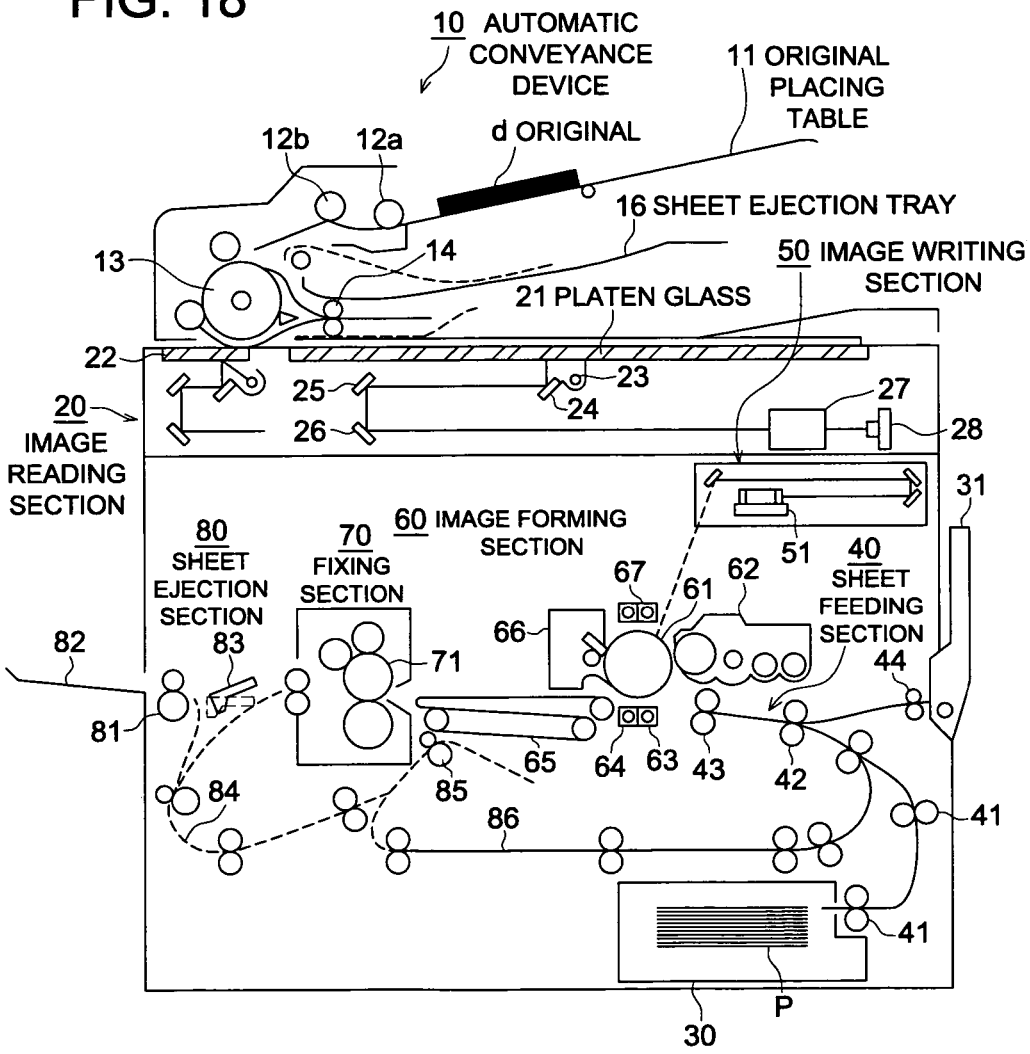
FIG. 18 is a cross-sectional view showing a structure of an image forming apparatus.
Figure 19:
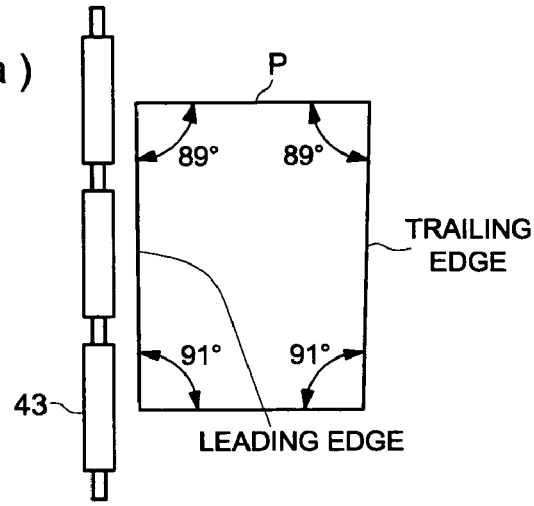
FIG. 19 is a top view for illustrating operations to correct a skew of a transfer sheet in an image forming apparatus relating to conventional technologies.
Figure 19:
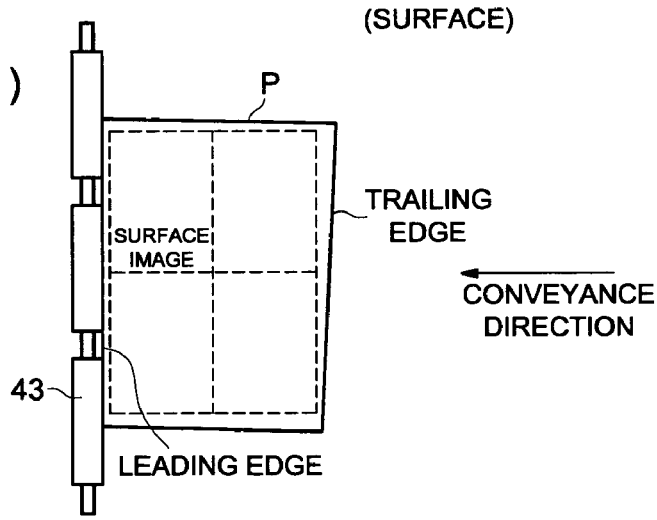
Figure 19:
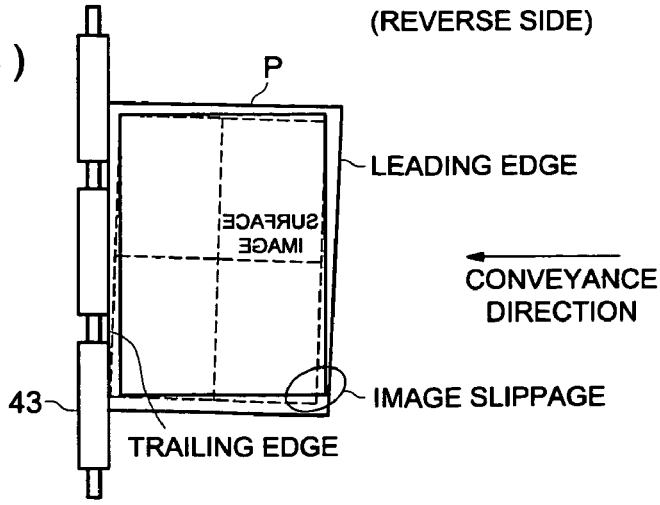

As shown in FIG. 18, an image forming apparatus relating to the present embodiment is composed of image reading section 20, sheet-feeding tray 30, sheet supply section 40, image writing section 50, image forming section 60, fixing section 70 and sheet ejection section 80.

In the present embodiment, information representing an outer shape of transfer sheet P is inputted with operation section 1. As an outer shape, there is given a skew (angle) of transfer sheet P. An operator inputs a skew (angle) of a leading edge of transfer sheet P and a skew (angle) of a trailing edge representing a side that is opposite to the leading edge, with operation section 1. The skew (angle) of a leading edge of transfer sheet P results in a correction value (angle) for a skew in the case of forming an image on the surface of transfer sheet P, while, the skew (angle) of a trailing edge results in a correction value (angle) for a skew in the case of forming an image on the reverse side.

Figure 2:
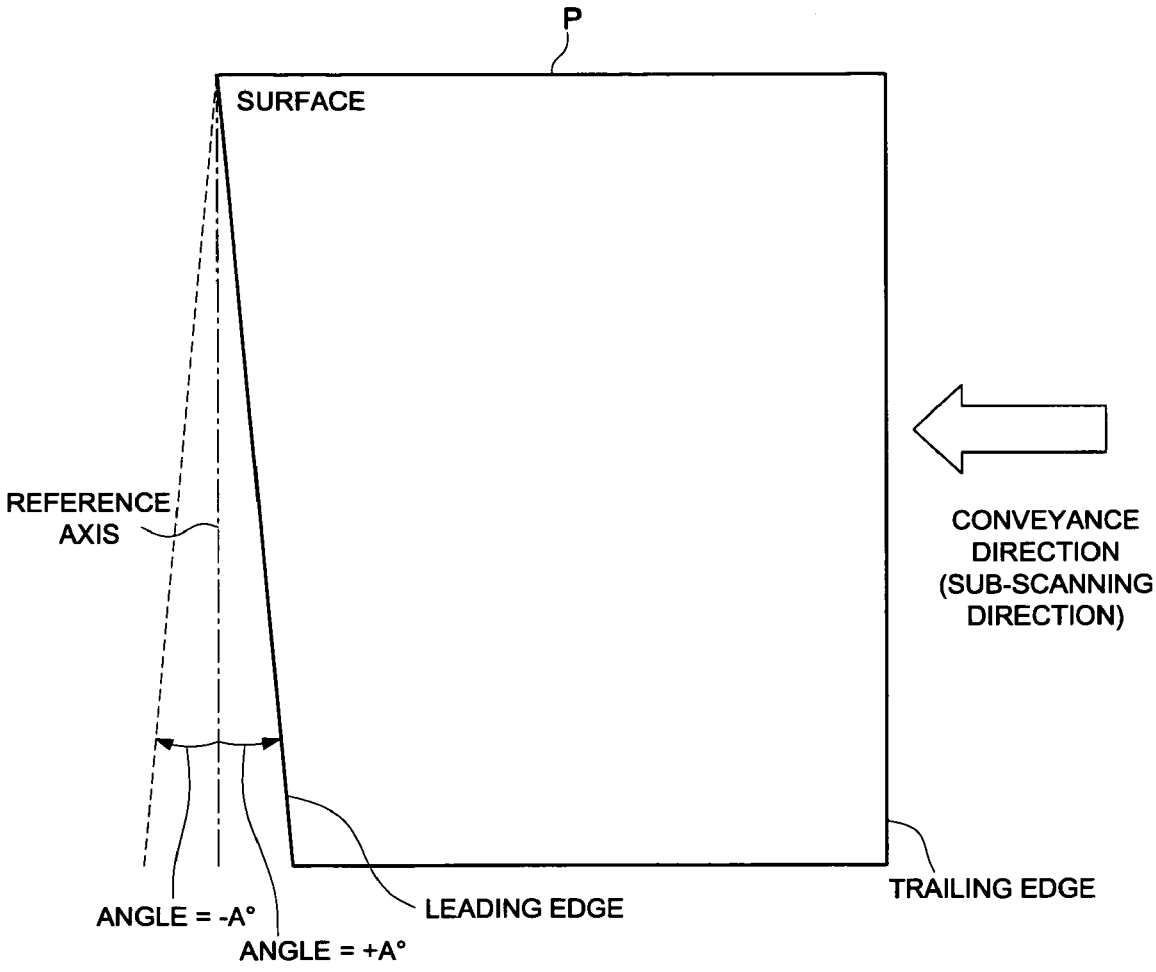
FIG. 2 is a top view showing an outer shape of a transfer sheet.

Now, a skew of transfer sheet P will be explained, referring to FIG. 2 which is a top view showing an outer shape of a transfer sheet. When forming an image on the front surface of transfer sheet P, a skew of the leading edge in the conveyance direction of transfer sheet P is corrected by causing the leading edge in the conveyance direction of transfer sheet P to hit a nip portion of the registration roller 43. When forming an image on the reverse side of transfer sheet P, a skew of the leading edge in the conveyance direction of transfer sheet P is corrected when transfer sheet P is reversed and a leading edge in the conveyance direction (the trailing edge shown in FIG. 2) is caused to hit the nip portion of the registration roller 43.

When an axis perpendicular to the conveyance direction serves as a reference axis, let it be assumed that a skew of the leading edge of transfer sheet P relative to the reference axis is angle A, and a skew of the trailing edge of transfer sheet P is angle B. When the leading edge of transfer sheet P is skewed to the conveyance direction, the direction of the skew is made to be "−" and a skew of the leading edge in this case is made to be "−A°". Further, as shown in FIG. 2, when the leading edge is skewed to the direction opposite to the conveyance direction, the direction of the skew is made to be "+" and a skew of the leading edge in this case is made to be "+A°". Even for the trailing edge, when the trailing edge is skewed to the conveyance direction, the direction of the skew is made to be "−" and a skew of the trailing edge in this case is made to be "−B°". Further, when the trailing edge is skewed to the direction opposite to the conveyance direction, the direction of the skew is made to be "+" and a skew of the trailing edge in this case is made to be "+B°".

When information showing a skew (angle) of transfer sheet P in inputted by an operator, the information showing the skew (angle) is stored in correction data storage section 3. Since a skew (angle) of transfer sheet P varies depending on a corner of transfer sheet P, a skew (angle) of the leading edge and a skew (angle) of the trailing edge are inputted by the use of operation section 1, to be stored in correction data storage section 3. In other words, when forming an image on the surface of transfer sheet P, a leading edge of transfer sheet P is caused to hit the registration roller 43 to correct the skew of transfer sheet P, while, when forming an image on the reverse side of transfer sheet P, transfer sheet P is reversed and a trailing edge of transfer sheet P is caused to hit the registration roller 43 to correct the skew of transfer sheet P. Therefore, the side hitting the registration roller 43 in the case of forming an image on the surface is different from that in the case of forming an image on the reverse side. Accordingly, the skew (angle) of the leading edge and the skew (angle) of the trailing edge are inputted to be stored in correction data storage section 3.

Operation section 1 is composed of an input portion and a display portion. The input portion includes a keyboard equipped with a cursor key, a numeral input key and respective functional keys, and a hold-down signal corresponding to the key pressed on the keyboard is outputted to controller 2. The display portion is composed of a liquid crystal display and an EL display, and it displays image data and text data on a screen in accordance with an instruction of display signals outputted from controller 2.

Pieces of information showing an outer shape of transfer sheet P inputted by operation section 1, namely, correction values for correcting a skew of transfer sheet P with the registration roller 43 are stored in correction data storage section 3. Since the correction values include a correction value for correcting a skew of transfer sheet P when forming an image on the surface of transfer sheet P and a correction value for correcting a skew of transfer sheet P when forming an image on the reverse side, a correction value for the surface and that for the reverse side are stored in the correction data storage section 3. Specifically, as a correction value for the surface, "+A°" or "−A°" which shows a skew of a leading edge is stored in correction data storage section 3. Further, as a correction value for the reverse side, "+B°" or "−B°" which shows a skew of a trailing edge is stored in correction data storage section 3.

The registration roller 43 is arranged in the direction perpendicular to the conveyance direction for transfer sheet P, and a skew of the leading edge of transfer sheet P for the conveyance direction of transfer sheet P is corrected when the transfer sheet P is caused to hit the registration roller 43. Further, the registration roller 43 is slanted in accordance with a correction value (angle) stored in correction data storage section 3, to correct the skew of transfer sheet P. The control for the slant of the registration roller 43 is made by drive controller 4. The drive controller 4 causes motor M to rotate in accordance with correction values (angles) stored in correction data storage section 2. When drive power of the motor M is transmitted to the registration roller 43, the registration roller 43 is slanted by an angle equivalent to the drive power to correct the skew of transfer sheet P.

Figure 3:
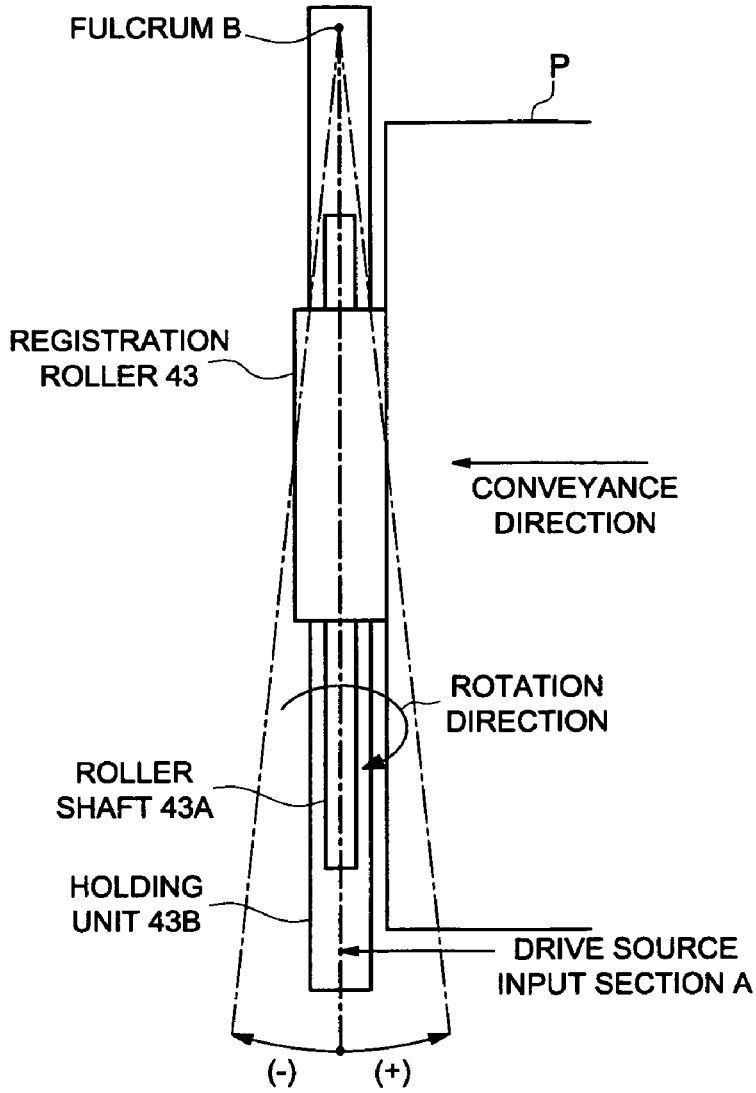
FIG. 3 is a top view showing a schematic structure of a registration roller.
Figure 3:
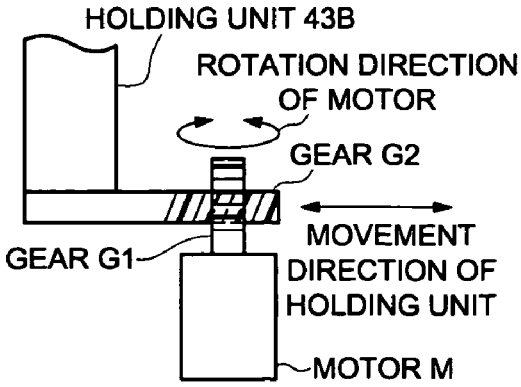
Figure 3:
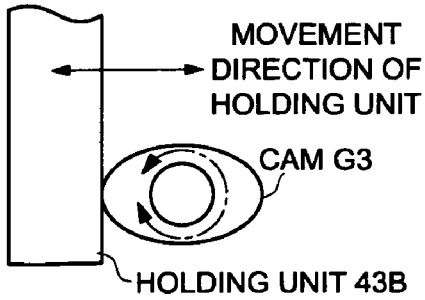

This registration roller 43 will be explained as follows, referring to FIG. 3. FIG. 3 is a top view showing a schematic structure of a registration roller. As shown in FIG. 3 (*a*), the registration roller 43 is installed on holding unit 43B and is arranged in the direction perpendicular to the conveyance direction of transfer sheet P. The registration roller 43 rotates on a rotation axis (roller rotation axis 43A) which is in the direction perpendicular to the conveyance direction. Then, drive power is inputted from drive source input section A by control of drive controller 4, and holding unit 43B is slanted on fulcrum B in the conveyance direction (−direction) or in the direction (+direction) opposite to the conveyance direction. When the holding unit 43B is slanted, the registration roller 43 installed on the holding unit 43B is slanted in the conveyance direction (−direction) or in its opposite direction (+direction). A slant of the registration roller 43 is in correspondence to the correction value (angle) stored in correction data storage section 3. For example, if a correction value stored in correction data storage section 3 is "negative (−)", the registration roller 43 is slanted in the "−" direction, and if a correction value is "positive (+)", the registration roller 43 is slanted in the "+" direction. Transfer sheet P is caused to hit the registration roller 43 under the condition that the registration roller 43 is slanted as stated above, whereby a skew of the transfer sheet P is corrected.

Next, a mechanism for slanting the registration roller 43 will be explained. In the present embodiment, two examples are given as a mechanism to slant the registration roller 43. First, a mechanism to slant the registration roller 43 by using a gear will be explained, referring to FIG. 3 (*b*). On holding unit 43B, there is provided gear G2 whose direction is in the conveyance direction. The gear G2 is engaged with gear G1 whose direction is in the direction perpendicular to the conveyance direction. The gear G1 is connected with motor M, and when the gear G1 is rotated by the motor M, a rotation of the gear G1 is transmitted to the gear G2, and holding unit 43B is swiveled on the fulcrum B representing an axis to be moved in the conveyance direction (−direction) or its opposite direction (+direction). Owing to this, a slant of the registration roller 43 can be changed.

Next, a mechanism for slanting the registration roller 43 by using a cam will be explained, referring to FIG. 3 (*c*) . The holding unit 43B is connected with cam G3, and when this cam G3 is rotated, the holding unit 43B is swiveled on the fulcrum B representing an axis to be moved in the conveyance direction (−direction) or its opposite direction (+direction) . Owing to this, a slant of the registration roller 43 can be changed.

Image processing section 5 is composed of reading controller 5A and writing controller 5B. The reading controller 5A controls image reading section 20, and the writing controller 5B controls image writing section 50. Incidentally, though FIG. 1 shows only the reading controller 5A and the writing controller 5B, the image processing section 5 may also conduct compression, extension or conversion of image data.

System controller 2 reads a correction value (angle) about a surface on which an image is formed from correction data storage section 3, and outputs the correction value to drive controller 4. For example, when forming an image on the surface of transfer sheet P, the system controller 2 reads a correction value about a surface of the system controller 2 from correction data storage section 3, and outputs to drive controller 4. Further, when image forming on the surface of transfer sheet P is completed, and when forming an image on the reverse side, the system controller 2 reads a correction value about the reverse side from correction data storage section 3, and outputs to drive controller 4.

Meanwhile, the system controller 2 is connected to various sections (image reading section 20, sheet-feeding section 40, image writing section 50, image forming section 60 and fixing section 70) of an image forming apparatus, and controls transfer processing, fixing processing and reversing processing.

(Operations)

Figure 4:
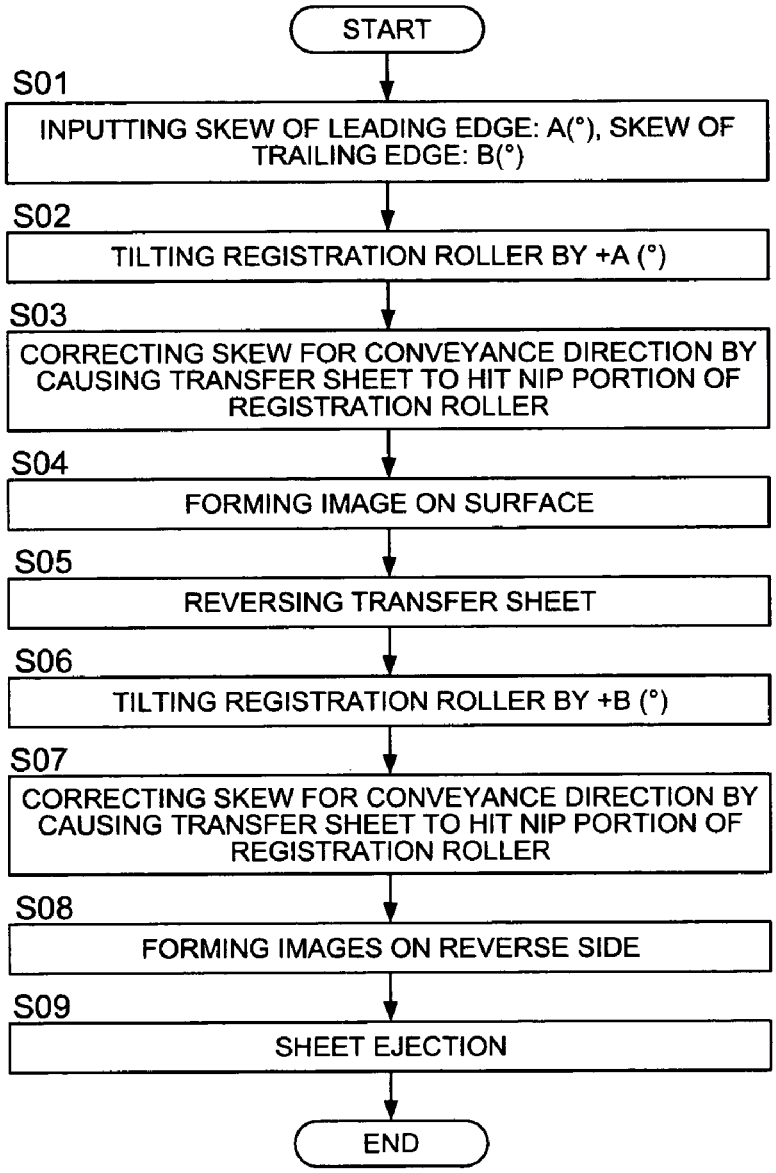
FIG. 4 is a flow chart for illustrating series of operations of an image forming apparatus relating to the first embodiment of the invention.

Next, operations (image forming method) of an image forming apparatus relating to the first embodiment will be explained. FIG. 4 is a flow chart for illustrating series of operations of an image forming apparatus relating to the first embodiment of the invention.

(step S01)

First, in step S01, an operator inputs information showing an outer shape of transfer sheet P, namely, information showing a skew (angle) of transfer sheet P, by using operation section 1. Specifically, an operator inputs "+A°" or "−A°" as a skew (angle) of a leading edge of transfer sheet P, and inputs "+B°" or "−B°" as a skew (angle) of a trailing edge. In this case, it is assumed that "+A°" is inputted as a skew of a leading edge and "+B°" is inputted as a skew of a trailing edge. The skew (angle) of the transfer sheet P inputted at the operation section 1 is stored in correction data storage section 3 as a correction value for the skew.

In the meantime, a skew (angle) of each transfer sheet P may also be inputted. By inputting a skew (angle) of each transfer sheet P, it is possible to correct a skew of each transfer sheet P even when each transfer sheet P varies slightly in terms of a shape.

(step S02)

In step S02, the registration roller 43 is slanted based on the correction value (angle) of the leading edge inputted during step S01. System controller 2 reads from correction data storage section 3 the correction value for the skew of the surface, and outputs to drive controller 4. After receiving the correction value from the system controller 2, the drive controller 4 causes motor M to rotate and slants the registration roller 43. For example, when a skew of the leading edge of transfer sheet P is "+A°", the drive controller 4 slants the registration roller 43 by "+A°" by causing motor M to rotate.

(step S03)

Next, in step S03, the leading edge of transfer sheet P hits a nip portion of the registration roller 43. In this case, a side (leading edge) of transfer sheet P in the conveyance direction hits a nip portion of the registration roller 43, and thereby, a prescribed loop is formed, and a skew of the transfer sheet P for the conveyance direction is corrected. The registration roller 43 is slanted from the conveyance direction by "+A°", and the leading edge of the transfer sheet P is skewed by "+A°", which means that a slant of the registration roller 43 agrees with a skew of the leading edge of the transfer sheet P. Due to this, the transfer sheet P is corrected in terms of a skew for the conveyance direction to be in parallel with the conveyance direction. After that, the transfer sheet P is conveyed to photoreceptor drum 61 of image forming section 60 at prescribed timing. By correcting the skew of transfer sheet P for the conveyance direction by slanting the registration roller 43 as stated above, it is possible to change a relative position between the transfer sheet P and the image formed on the surface, to form an image on the surface.

(step S04)

After the skew for the front surface has been corrected in step S03, a toner image is transferred onto transfer sheet P in image forming section 60, and the toner image thus transferred is fixed in fixing section 70.

(step S05)

Then, the transfer sheet P is conveyed again to image forming section 60 under the condition that the transfer sheet P has been reversed by reversing path 84, reversing conveyance roller 85 and reversing conveyance path 86, for forming an image on the reverse side.

(step S06)

In step S06, the registration roller 43 is slanted based on the correction value (angle) inputted during step S01. System controller 2 reads from correction data storage section 3 the correction value for the skew of the reverse side, and outputs to drive controller 4. After receiving the correction value from the system controller 2, the drive controller 4 causes motor M to rotate and slants the registration roller 43. For example, when a skew of the trailing edge of transfer sheet P is "+B°", the drive controller 4 slants the registration roller 43 by "+B°" by causing motor M to rotate.

(step S07)

Next, in step S07, the leading edge of transfer sheet P hits a nip portion of the registration roller 43. In this case, a side (trailing edge) of transfer sheet P hits a nip portion of the registration roller 43, and thereby, a prescribed loop is formed, and a skew of the transfer sheet P for the conveyance direction is corrected. The registration roller 43 is slanted from the conveyance direction by "+B°", and the trailing edge of the transfer sheet P is also skewed by "+B°", which means that a slant of the registration roller 43 agrees with a skew of the trailing edge of the transfer sheet P. Due to this, the transfer sheet P is corrected in terms of a skew for the conveyance direction to be in parallel with the conveyance direction. After that, the transfer sheet P is conveyed to photoreceptor drum 61 of image forming section 60 at prescribed timing. By correcting the skew of transfer sheet P for the conveyance direction by slanting the registration roller 43 as stated above, it is possible to change a relative position between the transfer sheet P and the image formed on the reverse side, to form an image on the reverse side.

(step S08)

After the skew about the reverse side is corrected in step S07, a toner image is transferred onto transfer sheet P at image forming section 60, and the transferred toner image is fixed at fixing section 70.

(step S09)

The transfer sheet P on which image fixing has been completed on each of the surface and the reverse side, is ejected by sheet-ejection roller 81 onto sheet-ejection tray 82.

In the image forming apparatus relating to the first embodiment, as stated above, a skew of transfer sheet P from the conveyance direction is corrected by changing a slant of the registration roller 43 in accordance with an outer shape of a transfer sheet, specifically with a skew of the leading edge of transfer sheet P and a skew of the trailing edge, thus, images formed on both surfaces can be aligned in terms of position highly accurately, by canceling positional difference between the image on the surface and the image on the reverse side.

Further, by correcting a skew of each transfer sheet P by inputting information showing a skew (angle) of each transfer sheet P, it is possible to correct a skew of each transfer sheet P even when each transfer sheet P varies slightly in terms of a shape.

Incidentally, it is possible to store information showing a skew (angle) of transfer sheet P inputted at operation section 1 in correction data storage section 3, and thereby to correct a skew of the succeeding transfer sheet P by using a correction value (angle) stored in the correction data storage section 3, when forming an image on the succeeding transfer sheet P. In other words, when forming an image on fresh transfer sheet P, it is possible to correct a skew of transfer sheet P without inputting an outer shape of transfer sheet P each time, by correcting a skew of fresh transfer sheet P by using an outer shape of the preceding transfer sheet P.

Second Embodiment

Figure 5:
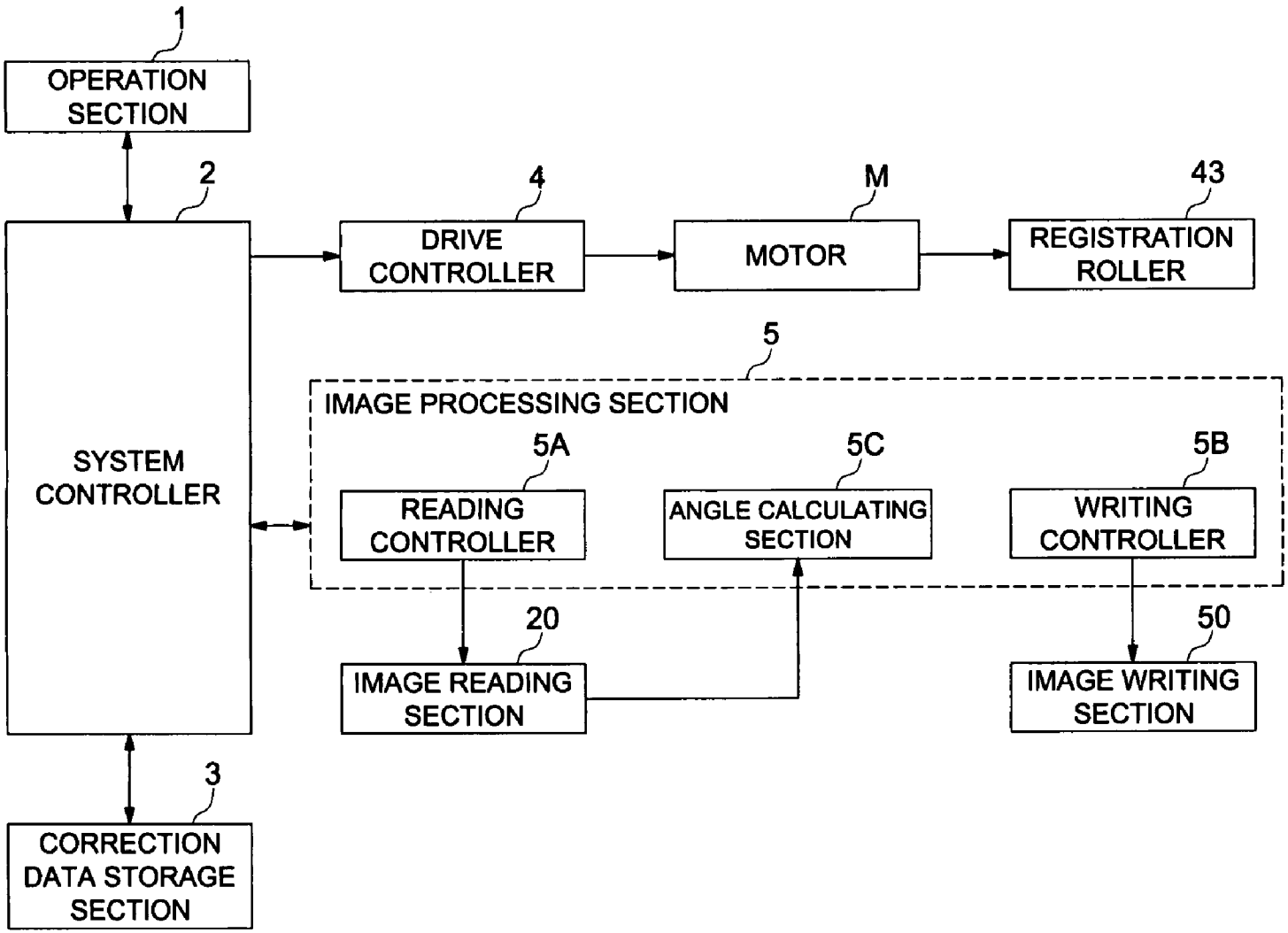
FIG. 5 is a block diagram showing a structure of an image forming apparatus relating to the second embodiment of the invention.

Structures of the image forming apparatus relating to the second embodiment of the invention will be explained as follows, referring to FIG. 5 which is a block diagram showing a structure of an image forming apparatus relating to the second embodiment of the invention.

In the same way as in the aforesaid first embodiment, the image forming apparatus relating to the second embodiment is composed of image reading section 20, sheet-feeding tray 30, sheet supply section 40, image writing section 50, image forming section 60, fixing section 70 and sheet ejection section 80. Further, a registration roller for correcting a skew of transfer sheet P also has the aforesaid constitution. In the same way as in the first embodiment, the image forming apparatus relating to the second embodiment is composed of system controller 2, correction data storage section 3, drive controller 4, motor M and registration roller 43.

In the second embodiment, image reading section 20 is used to read information showing an outer shape of transfer sheet P, in place of inputting the outer shape of transfer sheet P from operation section 1. As an outer shape, there are given a skew (angle) of a leading edge and a skew (angle) of a trailing edge of transfer sheet P, in the same way as in the first embodiment.

Image reading section 20 generates image data by scanning transfer sheet P optically. The image data represent an outer shape of transfer sheet P. After the outer shape of transfer sheet P is read by the image reading section 20, information showing the outer shape is outputted to angle calculating section 5C of image processing section 5. The angle calculating section 5C obtains a skew (angle) of a leading edge and a skew (angle) of a trailing edge of transfer sheet P from the outer shape. For example, as shown in a top view in FIG. 2, when the direction that is in parallel with a shorter side of transfer sheet P is made to be the conveyance direction, the axis perpendicular to this conveyance direction is made to be a reference axis. Then, the angle calculating section 5C obtains a skew of a leading edge relative to the reference axis, and its angle is made to be angle A and a skew of a trailing edge is made to be angle B.

The information showing a skew (angle) of the leading edge and a skew (angle) of the trailing edge of transfer sheet P obtained by the angle calculating section 5C are stored in correction data storage section 3 as a correction value for a skew of transfer sheet P. Drive controller 4 slants the registration roller 43 in accordance with the correction value (angle) stored in correction data storage section 3, in the same way as in the first embodiment.

(Operations)

Figure 6:
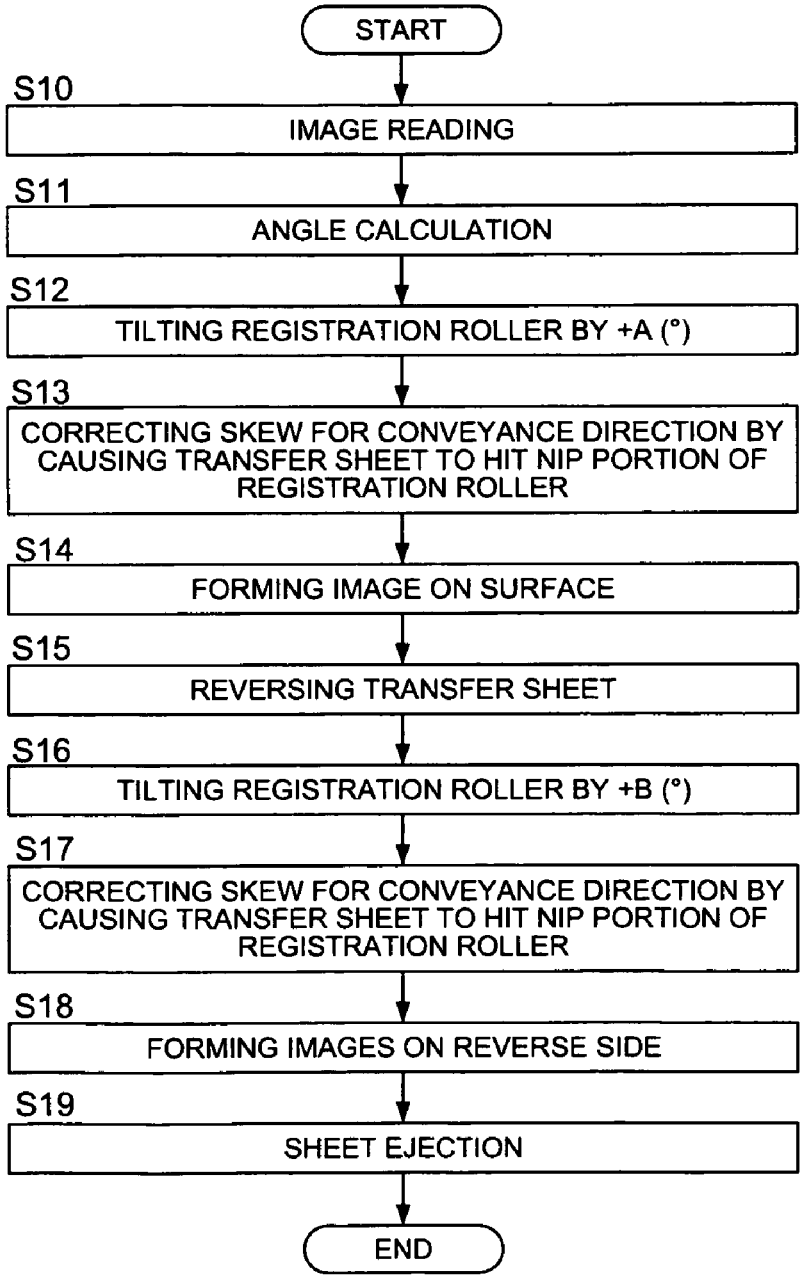
FIG. 6 is a flow chart for illustrating series of operations of an image forming apparatus relating to the second embodiment of the invention.

Operations (image forming method) of an image forming apparatus relating to the second embodiment will be explained next, referring to FIG. 6. FIG. 6 is a flow chart for illustrating series of operations of an image forming apparatus relating to the second embodiment of the invention.

(step S10)

First, in step S10, an outer shape of transfer sheet P is read by image reading section 20. Information showing the outer shape is outputted to angle calculating section 5C.

(step S11)

Next, in step S11, the angle calculating section 5C calculates a skew of transfer sheet P based on information showing the outer shape of transfer sheet P. Specifically, the angle calculating section 5C calculates a skew (angle) of the leading edge and a skew (angle) of the trailing edge of transfer sheet P. In this case, it is assumed that "+A°" represents a skew of the leading edge of transfer sheet P and "+B°" represents a skew of the trailing edge. Information showing these skews is stored in correction data storage section 3.

(step S12)

Then, in step S12, the registration roller 43 is slanted in accordance with a correction value (angle) of the leading edge of transfer sheet P. System controller 2 reads a correction value for the skew of the surface from correction data storage section 3, and outputs to drive controller 4. After receiving the correction value from the system controller 2, the drive controller 4 causes motor M to rotate to slant the registration roller 43. For example, when the skew of the leading edge of transfer sheet P is "+A°", the drive controller 4 slants the registration roller 43 by "+A°" by causing the motor M to rotate.

(step S13)

Next, in step S13, the leading edge of transfer sheet P is caused to hit a nip portion of the registration roller 43. In this case, a side of transfer sheet P in the conveyance direction (a leading edge) hits the nip portion of the registration roller 43, and thereby, a prescribed loop is formed and a skew of transfer sheet P for the conveyance direction is corrected. Since the slant of the registration roller 43 for the conveyance direction agrees with the skew of transfer sheet P for the conveyance direction, the skew of transfer sheet P for the conveyance direction is corrected to be in parallel with the conveyance direction. After that, the transfer sheet P is conveyed to photoreceptor drum 61 of image forming section 60 at prescribed timing. By correcting the skew of transfer sheet P for the conveyance direction by slanting the registration roller 43 as stated above, it is possible to form an image on the surface by changing a relative position between the transfer sheet P and the image formed on the surface.

(step S14)

After the skew concerning the surface is corrected in step S13, a toner image is transferred onto transfer sheet P by image forming section 60, and the toner image thus transferred is fixed by fixing section 70.

(step S15)

Then, for the purpose of forming an image on the reverse side, the transfer sheet P is conveyed again to the image forming section 60, under the condition where the transfer sheet P is reversed by reversing path 84, reversing conveyance roller 85 and reversing conveyance path 86.

(step S16)

In step S16, the registration roller 43 is slanted in accordance with a correction value (angle) of a trailing edge of transfer sheet P. System controller 2 reads a correction value for the skew of the reverse side from correction data storage section 3, and outputs to drive controller 4. After receiving the correction value from the system controller 2, the drive controller causes motor M to rotate to slant the registration roller 43. For example, when a skew of the trailing edge of transfer sheet P is "+B°", the drive controller 4 slants the registration roller 43 by "+B°" by causing motor M to rotates.

(step S17)

Next, in step S17, the trailing edge of transfer sheet P is caused to hit a nip portion of the registration roller 43. In this case, a side of transfer sheet P in the conveyance direction (a trailing edge) hits the nip portion of the registration roller 43, and thereby, a prescribed loop is formed and a skew of transfer sheet P for the conveyance direction is corrected. Since the slant of the registration roller 43 for the conveyance direction agrees with the skew of transfer sheet P for the conveyance direction, the skew of transfer sheet P for the conveyance direction is corrected to be in parallel with the conveyance direction. After that, the transfer sheet P is conveyed to photoreceptor drum 61 of image forming section 60 at prescribed timing. By correcting the skew of transfer sheet P for the conveyance direction by slanting the registration roller 43 as stated above, it is possible to form an image on the reverse side by changing a relative position between the transfer sheet P and the image formed on the reverse side.

(step S18)

After the skew concerning the reverse side is corrected in step S18, a toner image is transferred onto transfer sheet P by image forming section 60, and the toner image thus transferred is fixed by fixing section 70.

(step S19)

The transfer sheet P on which image fixing on each of the surface and the reverse side has been terminated is ejected to sheet ejection tray 82 by sheet ejection roller 81.

In the image forming apparatus relating to the second embodiment, it is possible to make a positional slippage of an image on the surface and that on the reverse side to offset each other, and thereby, to align images formed on both sides highly accurately, by correcting a skew of transfer sheet P for the conveyance direction by changing a slant of the registration roller 43 depending on an outer shape of a transfer sheet, specifically, on a skew of the leading edge and a skew of the trailing edge of transfer sheet P, as stated above.

Further, by correcting a skew of each transfer sheet P by reading a skew (angle) of each transfer sheet P, it is possible to correct a skew of each transfer sheet P even when each transfer sheet P fluctuates slightly in terms of a shape.

Incidentally, it is possible to store information showing a skew (angle) of transfer sheet P read by image reading section 20 in correction data storage section 3, and thereby to correct a skew of the succeeding transfer sheet P by using the correction value (angle) stored in the correction data storage section 3, when forming an image on the succeeding transfer sheet P. In other words, when forming an image on fresh transfer sheet P, it is possible to correct a skew of fresh transfer sheet P by correcting a skew of fresh transfer sheet P by using an outer shape of the preceding transfer sheet P, and thereby to correct the skew of transfer sheet P one after another without obtaining the outer shape of the fresh transfer sheet P.

Third Embodiment

Figure 7:
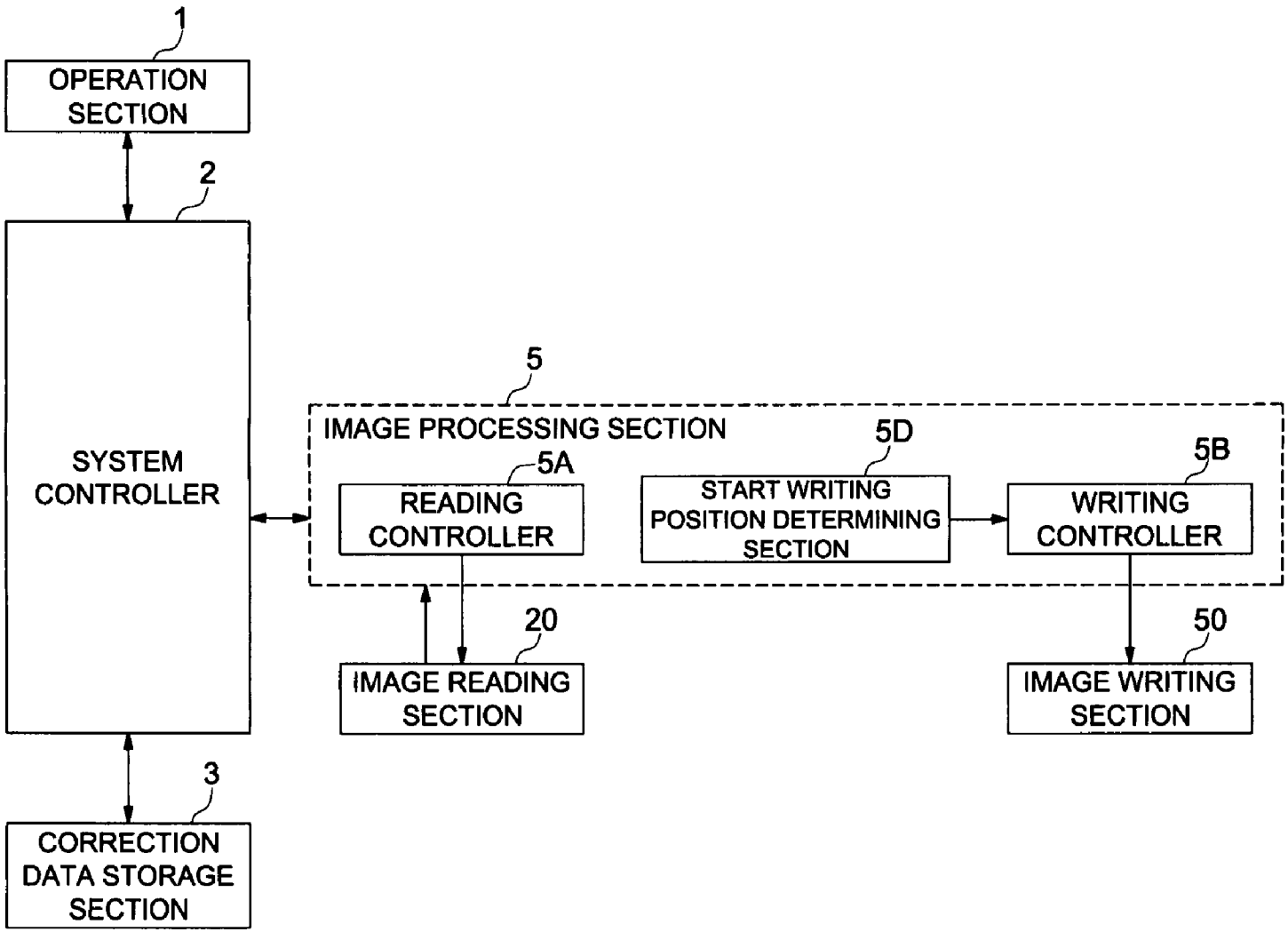
FIG. 7 is a block diagram showing a structure of an image forming apparatus relating to the third embodiment of the invention.

Structures of the image forming apparatus relating to the third embodiment of the invention will be explained as follows, referring to FIG. 7 which is a block diagram showing a structure of the image forming apparatus relating to the third embodiment of the invention.

In the same way as in the aforesaid first embodiment, the image forming apparatus relating to the third embodiment is composed of image reading section 20, sheet-feeding tray 30, sheet supply section 40, image writing section 50, image forming section 60, fixing section 70 and sheet ejection section 80 shown in FIG. 18. In the same way as in the first embodiment, the image forming apparatus relating to the third embodiment is further composed of system controller 2 and correction data storage section 3.

In the third embodiment, information showing an outer shape of transfer sheet P, namely, information showing a skew (angle) of the leading edge and a skew (angle) of the trailing edge of transfer sheet P is inputted by using operation section 1, in the same way as in the first embodiment. The skew (angle) of the leading edge and the skew (angle) of the trailing edge thus inputted are stored in correction data storage section 3.

In the third embodiment, a position of an image on the surface and a position of an image on the reverse side are caused to agree each other by changing an image forming condition such as a position to start writing an image, in place of changing a slant of the registration roller 43 in accordance with a skew of transfer sheet P. By changing a position to start writing an image as stated above, it is possible to change a relative position between transfer sheet P and an image to be formed on the surface and a relative position between transfer sheet P and an image to be formed on the reverse side, and thereby to form an image on the surface or on the reverse side.

Start writing position determining section 5D of image processing section 5 reads information showing a skew (angle) from correction data storage section 3, and determines a position to start writing corresponding to the angle. The position to start writing determined by the start writing position determining section 5D corresponds to the position to start writing in the main scanning direction for an electrostatic latent image to be formed on photoreceptor drum 61. Writing controller 5B causes an electrostatic latent image to be formed on photoreceptor drum 61 by controlling image writing section 50 in accordance with the position to start writing determined by the start writing position determining section 5D.

Figure 8:
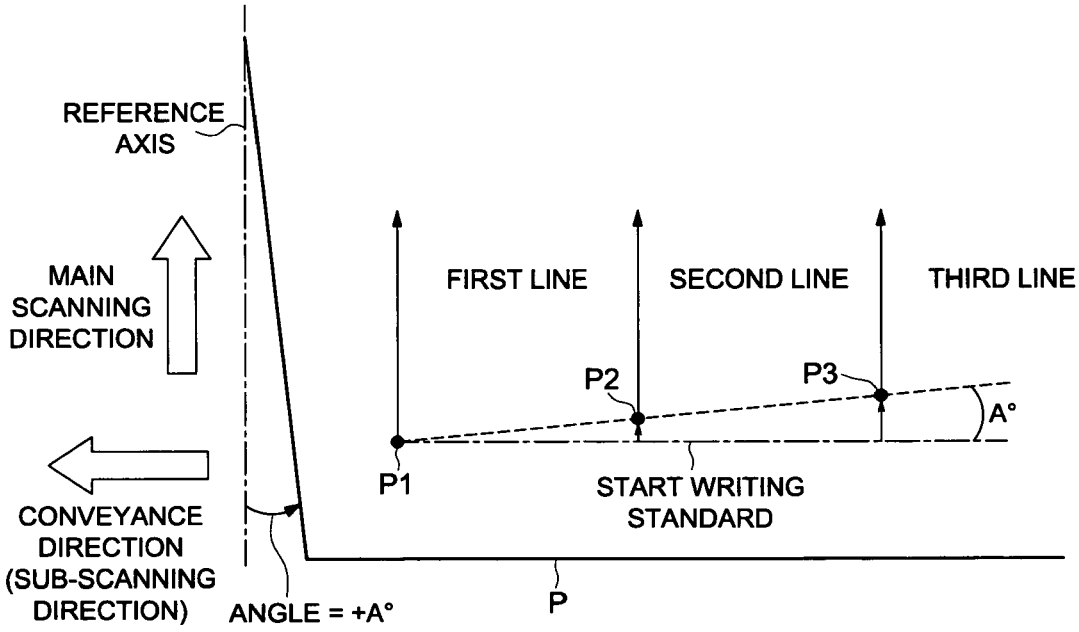
FIG. 8 is a pattern diagram for illustrating a position of start writing images.

Now, a position to start writing an image will be explained as follows, referring to FIG. 8. FIG. 8 is a pattern diagram for illustrating a position to start writing an image. When a laser beam is projected on photoreceptor drum 61 by image writing section 50 in the main scanning direction, and when the laser beam is caused to scan photoreceptor drum 61 by a polygon mirror of image writing section 50 in the sub-scanning direction, an electrostatic latent image is formed on the photoreceptor drum 61. Specifically, when a laser beam is projected along the first line, second line, third line, . . . which are in parallel with the main scanning direction, an electrostatic latent image is formed on the photoreceptor drum 61.

For example, when the leading edge of transfer sheet P is skewed by "+A°", start writing position determining section 5D changes the position to start writing for each line in accordance with that angle "+A°". To be concrete, the start writing position determining section 5D changes a position to start writing in the main scanning direction in accordance with angle "+A°" depending on the first, second, third . . . lines. In other words, when the position to start writing in the main scanning direction is changed depending on the first, second, third, . . . lines, an electrostatic latent is formed obliquely on the photoreceptor drum 61.

When the leading edge of transfer sheet P is skewed by "+A°", the start writing position determining section 5D makes start writing standard position P1 to be the position to start writing images for the first line, then, makes position P2 deviated from the original start writing standard established in advance, by angle "+A°", to be the position to start writing images for the second line, and makes position P3 deviated from the original start writing standard by angle "+A°" to be the position to start writing images for the third line. By changing the position to start writing in the main scanning direction for each line in accordance with an angle of the leading edge or the trailing edge of transfer sheet P as stated above, a slanted electrostatic latent image is formed on photoreceptor drum 61, and a slanted image is transferred onto transfer sheet P accordingly.

Specifically, the start writing position determining section 5D determines a start writing position based on the following expression (1).

$$\text{Start writing position for each line} = \text{Position of start writing standard} - 25.4\ (\text{mm})/(I \times \tan(A)) \qquad \text{Expression (1)}$$

In this case, the position of start writing standard is an original start writing position established in advance. Further, I represents the resolution which is represented by the number of lines in the sub-scanning direction per one inch. For example, when the resolution is 600 (dpi), I is 600.

The start writing position determining section 5D determines the start writing position for each line in accordance with the aforesaid expression (1), and outputs coordinate information showing the aforesaid position to writing controller 5B. In the example shown in FIG. 8, the start writing position determining section 5D outputs coordinate information of start writing position P1 for the first line, coordinate information of start writing position P2 for the second line, coordinate information of start writing position P3 for the third line . . . to the writing controller 5B. After receiving coordinate information showing the start writing position for each line, the writing controller 5B causes image writing section 50 to form an electrostatic latent slanted by angle "+A°" on photoreceptor drum 61.

An electrostatic latent image formed on photoreceptor drum 61 is transferred onto transfer sheet P. Due to this, the image which is slanted by "+A°" from an angle that is originally transferred is formed on transfer sheet P. By changing the start writing position in the main scanning direction as stated above, it is possible to form an image by changing a relative position between transfer sheet P and an image.

Even for the images to be formed on the reverse side of transfer sheet P, the position to start writing images is changed in accordance with a skew of the trailing edge, and an electrostatic latent image is formed on photoreceptor drum 61. Then, when the electrostatic latent image is transferred onto transfer sheet P, the image which is slanted by "+B°" or "−B°" from an angle that is originally transferred is formed on transfer sheet P.

(Operations)

Figure 9:
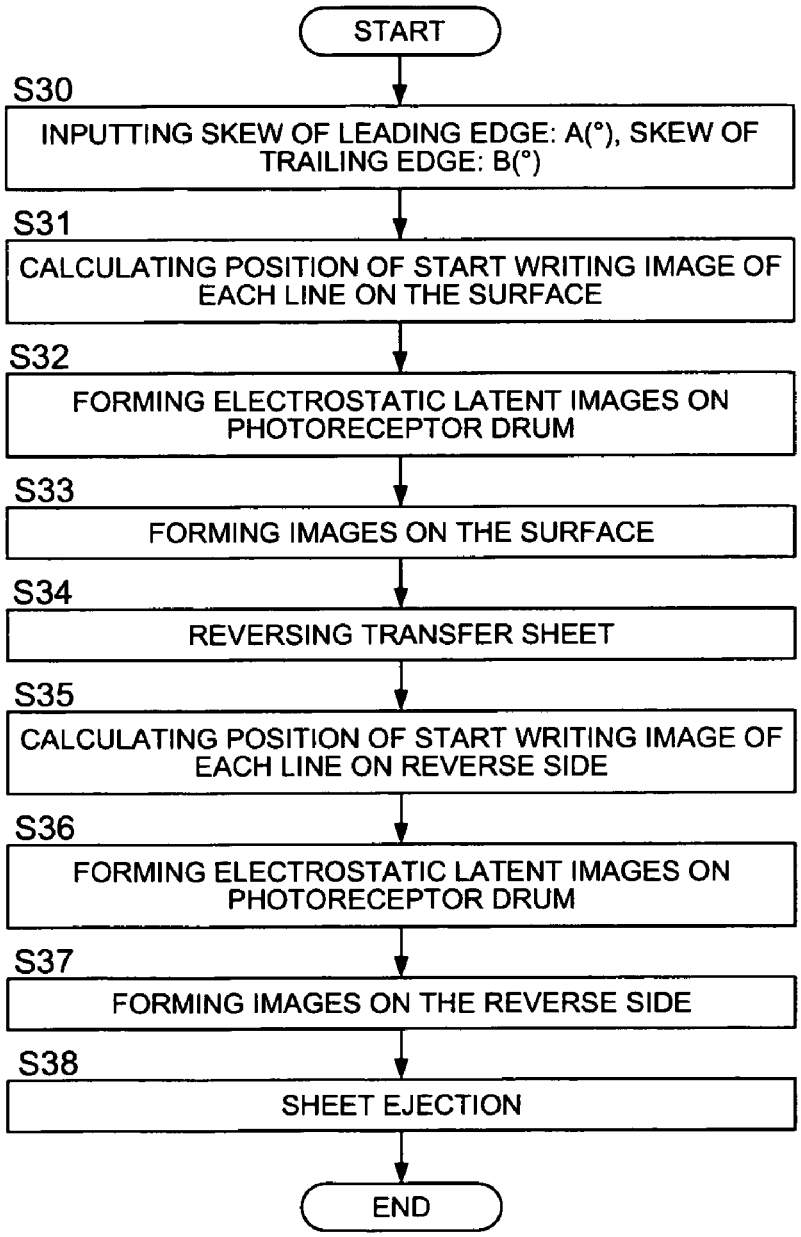
FIG. 9 is a flow chart for illustrating series of operations of an image forming apparatus relating to the third embodiment of the invention.

Next, operations (image forming method) of an image forming apparatus relating to the third embodiment will be explained as follows, referring to FIG. 9. FIG. 9 is a flow chart for illustrating a series of operations of an image forming apparatus relating to the third embodiment of the invention.

(step S30)

First, in step S30, an operator inputs information showing an outer shape of transfer sheet P, namely, information showing a skew (angle) of transfer sheet P by using operation section 1. Specifically, in the same way as in the aforesaid first embodiment, "+A°" or "−A°" is inputted as a skew (angle) of the leading edge of transfer sheet P and "+B°" or "−B°" is inputted as a skew (angle) of the trailing edge. In this case, it is assumed that "+A°" is inputted as a skew of the leading edge and "+B°" is inputted as a skew of the trailing edge. A skew (angle) of transfer sheet P inputted at operation section 1 is stored in correction data storage section 3 as a correction value for the skew.

(step S31)

In step S31, the start writing position determining section 5D reads, from correction data storage section 3, a correction value (angle: +A°) for the surface, and determines a start writing position for each line in the main scanning direction, in accordance with the aforesaid expression (1). Then, the start writing position determining section 5D outputs information (coordinate information) showing a start writing position for each line to writing controller 5B.

(step S32)

Next, in step S32, an electrostatic latent image is formed on photoreceptor drum 61. In this case, the writing controller 5B controls image writing section 50 based on the start writing position for each line determined by the start writing position determining section 5D, to form an electrostatic latent on photoreceptor drum 61. Owing to this, an electrostatic latent image that is slanted from the original start writing standard by an angle "+A°" is formed on photoreceptor drum 61.

(step S33)

Then, in step S33, a toner image is transferred onto the surface of transfer sheet P by image forming section 60, and the toner image thus transferred is fixed by fixing section 70. Owing to this, an image that is slanted from the original transferred angle by an angle "+A°" is formed on transfer sheet P.

(step S34)

Then, for the purpose of forming an image on the reverse side, transfer sheet P is sent again to image forming section 6 under the condition that the transfer sheet P is reversed by reversing path 84, reversing and conveying roller 85 and reversing and conveying path 86.

(step S35)

In step S35, the start writing position determining section 5D reads, from correction data storage section 3, a correction value (angle: +B°) for the reverse side and determines a start writing position for each line in the main scanning direction, in accordance with the aforesaid expression (1). Then, the start writing position determining section 5D outputs information (coordinate information) showing a start writing position for each line to writing controller 5B.

(step S36)

Next, in step S36, an electrostatic latent image is formed on photoreceptor drum 61. In this case, the writing controller 5B controls image writing section 50 based on the start writing position for each line determined by the start writing position determining section 5D, to form an electrostatic latent on the photoreceptor drum. Owing to this, an electrostatic latent image that is slanted from the original start writing standard by an angle "+B°" is formed on photoreceptor drum 61.

(step S37)

Then, in step S37, a toner image is formed on the reverse side of transfer sheet P by image forming section 60, and the toner image thus transferred is fixed by fixing section 70. Owing to this, an image that is slanted from the original transferred angle by an angle "+B°" is formed on transfer sheet P.

(step S38)

The transfer sheet P on which image fixing has been completed on each of the surface and the reverse side, is ejected by sheet-ejection roller 81 onto sheet-ejection tray 82.

As stated above, in the image forming apparatus relating to the third embodiment, an image is formed by changing a position to start writing an image, in accordance with an outer shape of a transfer sheet, specifically with a skew of the leading edge of transfer sheet P and a skew of the trailing edge, thus, images formed on both surfaces can be aligned in terms of position highly accurately, by canceling positional difference between the image on the surface and the image on the reverse side.

Further, by correcting a skew of each transfer sheet P by inputting information showing a skew (angle) of each transfer sheet P, it is possible to correct a skew of transfer sheet P even when each transfer sheet P fluctuates slightly in terms of a shape.

Incidentally, it is possible to store information showing a skew (angle) of transfer sheet P inputted by operation section 1 in correction data storage section 3, and thereby to correct a skew of the succeeding transfer sheet P by using the correction value (angle) stored in the correction data storage section 3, when forming an image on the succeeding transfer sheet P.

Fourth Embodiment

Figure 10:
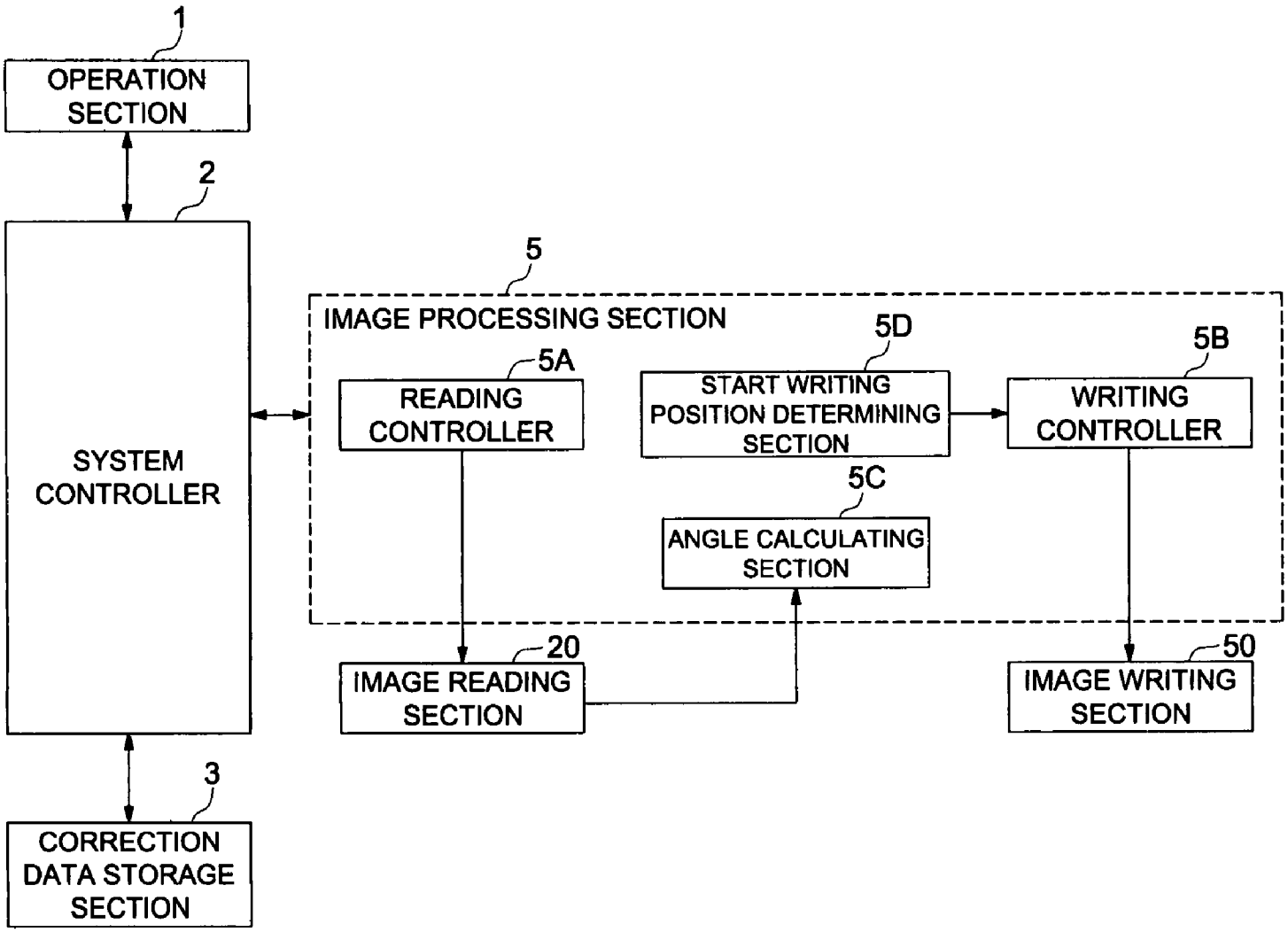
FIG. 10 is a block diagram showing a structure of an image forming apparatus relating to the fourth embodiment of the invention.

Next, structures of the image forming apparatus relating to the fourth embodiment of the invention will be explained as follows, referring to FIG. 10 which is a block diagram showing a structure of the image forming apparatus relating to the fourth embodiment of the invention.

In the same way as in the aforesaid first embodiment, the image forming apparatus relating to this embodiment is composed of image reading section 20, sheet-feeding tray 30, sheet supply section 40, image writing section 50, image forming section 60, fixing section 70 and sheet ejection section 80 shown in FIG. 18. In the same way as in the first embodiment, the image forming apparatus relating to the fourth embodiment is further composed of system controller 2 and correction data storage section 3.

In the fourth embodiment, image reading section 20 reads an outer shape of transfer sheet P, and angle calculating section 5C obtains a skew (angle) of transfer sheet P based on information showing the aforesaid outer shape, in the same way as in the second embodiment. Information showing a skew (angle) of the leading edge of transfer sheet P and information showing a skew (angle) of the trailing edge are stored in correction data storage section 3.

Further, in the fourth embodiment, a position of an image on the surface and a position of an image on the reverse side are caused to agree with each other, by changing a position to start writing an image in accordance with a skew of transfer sheet P, in the same way as in the third embodiment. In other words, the start writing position determining section 5D reads, from correction data storage section 3, information showing a skew (angle) of the surface or of the reverse side, and determines a start writing position for each line in the main scanning direction corresponding to each angle. Specifically, as explained in the third embodiment, the start writing position determining section 5D obtains the start writing position for each line in the main scanning direction, following expression (1). Then, writing controller 5B controls image writing section 50 in accordance with the position to start writing determined by the start writing position determining section 5D to form an electrostatic latent image on photoreceptor drum 61.

(Operations)

Figure 11:
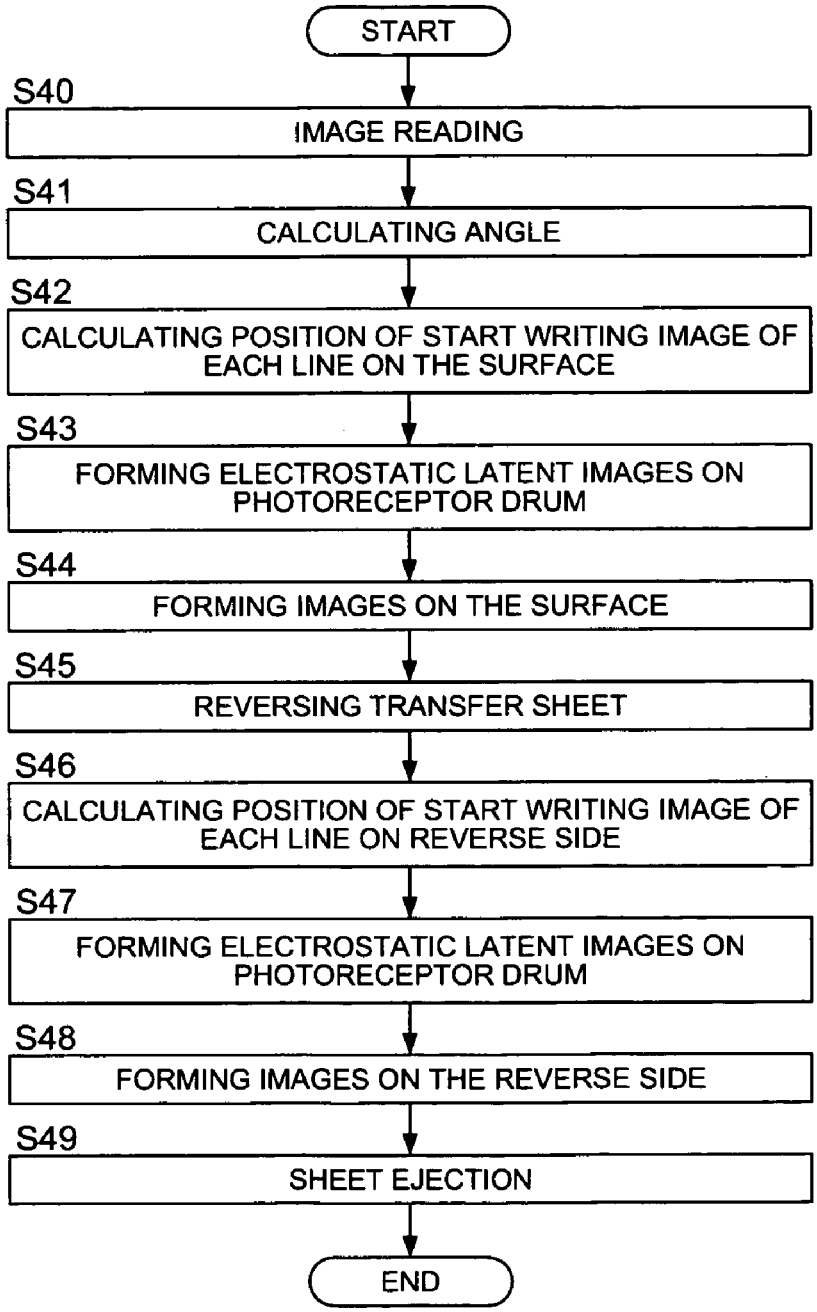
FIG. 11 is a flow chart for illustrating series of operations of an image forming apparatus relating to the fourth embodiment of the invention.

Next, operations (image forming method) of an image forming apparatus relating to the fourth embodiment of the invention will be explained as follows, referring to FIG. 11. FIG. 11 is a flow chart for illustrating a series of operations of an image forming apparatus relating to the fourth embodiment of the invention.

(step S40)

First, in step S40, an outer shape of transfer sheet P is read by image reading section 20, and information showing that outer shape is outputted to angle calculating section 5C.

(step S41)

Next, in step S41, the angle calculating section 5C calculates a skew of transfer sheet P based on information showing the outer shape of transfer sheet P. Specifically, the angle calculating section 5C calculates a skew (angle) of the leading edge and a skew (angle) of the trailing edge of transfer sheet P. In this case, it is assumed that "+A°" represents a skew of the leading edge of transfer sheet P and "+B°" represents a skew of the trailing edge. Information showing these skews is stored in correction data storage section 3.

(step S42)

In step S42, the start writing position determining section 5D reads, from correction data storage section 3, a correction value (angle: +A°) for the surface, and determines a start writing position for each line in the main scanning direction, in accordance with the aforesaid expression (1). Then, information (coordinate information) showing the start writing position for each line is outputted to writing controller 5B.

(step S43)

Next, in step S43, an electrostatic latent image is formed on photoreceptor drum 61. In this case, the writing controller 5B controls image writing section 50 based on the start writing position for each line determined by the start writing position determining section 5D, to form an electrostatic latent on photoreceptor drum 61. Owing to this, an electrostatic latent image that is slanted from the original start writing standard by an angle "+A°" is formed on photoreceptor drum 61.

(step S44)

Then, in step S44, a toner image is transferred onto the surface of transfer sheet P by image forming section 60, and the toner image thus transferred is fixed by fixing section 70. Owing to this, an image that is slanted from the original transferred angle by an angle "+A°" is formed on transfer sheet P.

(step S45)

Then, for the purpose of forming an image on the reverse side, transfer sheet P is sent again to image forming section 6 under the condition that the transfer sheet P is reversed by reversing path 84, reversing and conveying roller 85 and reversing and conveying path 86.

(step S46)

In step S46, the start writing position determining section 5D reads, from correction data storage section 3, a correction value (angle: +B°) for the reverse side and determines a start writing position for each line in the main scanning direction, in accordance with the aforesaid expression (1). Then, information (coordinate information) showing a start writing position for each line is outputted to writing controller 5B.

(step S47)

Next, in step S47, an electrostatic latent image is formed on photoreceptor drum 61. In this case, the writing controller 5B controls image writing section 50 based on the start writing position for each line determined by the start writing position determining section 5D, to form an electrostatic latent on the photoreceptor drum. Owing to this, an electrostatic latent image that is slanted from the original start writing standard by an angle "+B°" is formed on photoreceptor drum 61.

(step S48)

Then, in step S48, a toner image is formed on the reverse side of transfer sheet P by image forming section 60, and the toner image thus transferred is fixed by fixing section 70. Owing to this, an image that is slanted from the original transferred angle by an angle "+B°" is formed on transfer sheet P.

(step S49)

The transfer sheet P on which image fixing has been completed on each of the surface and the reverse side, is ejected by sheet-ejection roller 81 onto sheet-ejection tray 82.

As stated above, in the image forming apparatus relating to the fourth embodiment, an image is formed by changing a position to start writing an image, in accordance with an outer shape of a transfer sheet, specifically with a skew of the leading edge of transfer sheet P and a skew of the trailing edge, thus, images formed on both surfaces can be aligned in terms of position highly accurately, by canceling positional difference between the image on the surface and the image on the reverse side.

Further, by correcting a skew of each transfer sheet P by reading a skew (angle) for each transfer sheet P, it is possible to correct a skew of each transfer sheet P even when each transfer sheet P fluctuates slightly in terms of a shape.

Incidentally, it is possible to store information showing a skew (angle) of transfer sheet P read by image reading section 20 in correction data storage section 3, and thereby to correct a skew of the succeeding transfer sheet P by using the correction value (angle) stored in the correction data storage section 3, when forming an image on the succeeding transfer sheet P.

Fifth Embodiment

Figure 12:
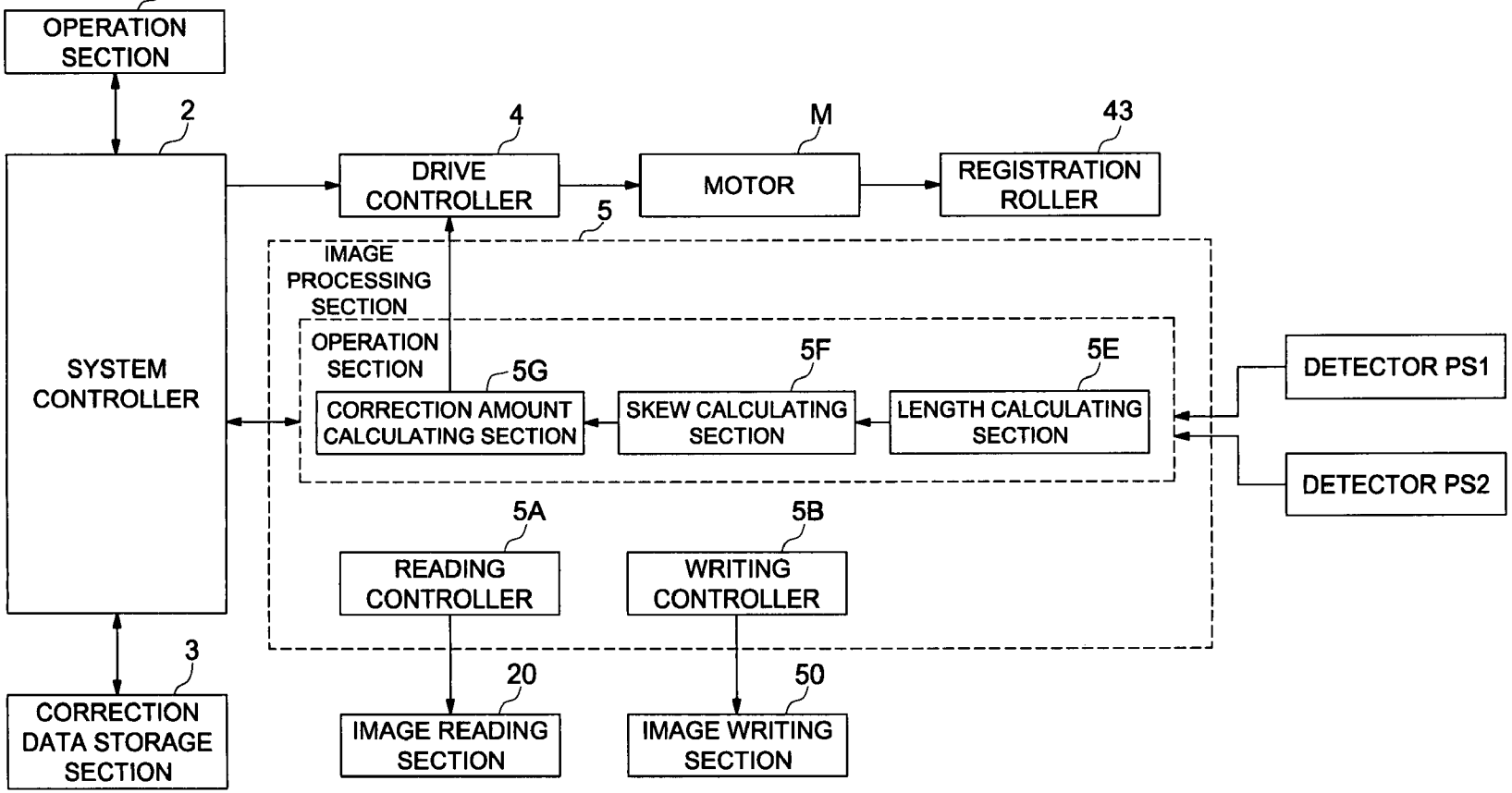
FIG. 12 is a block diagram showing a structure of an image forming apparatus relating to the fifth embodiment of the invention.
Figure 13:
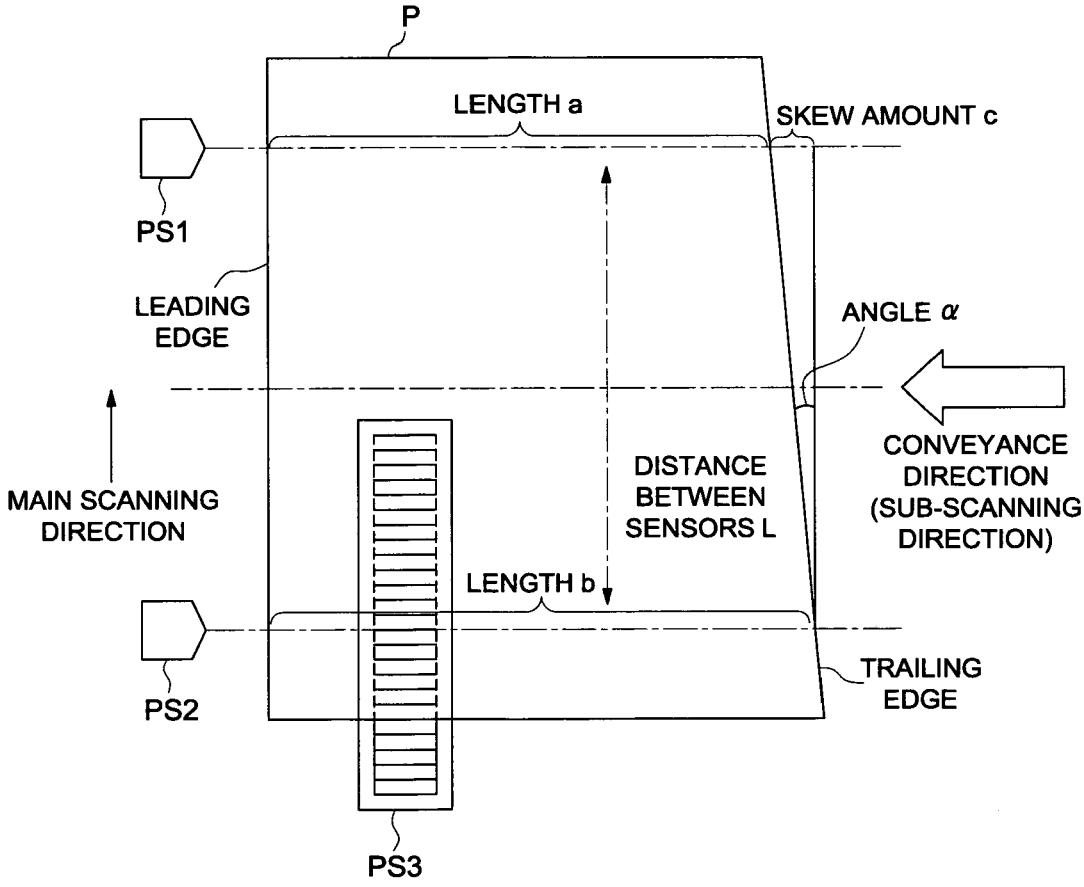
FIG. 13 is a top view showing an arrangement of a photodetector.
Figure 14:
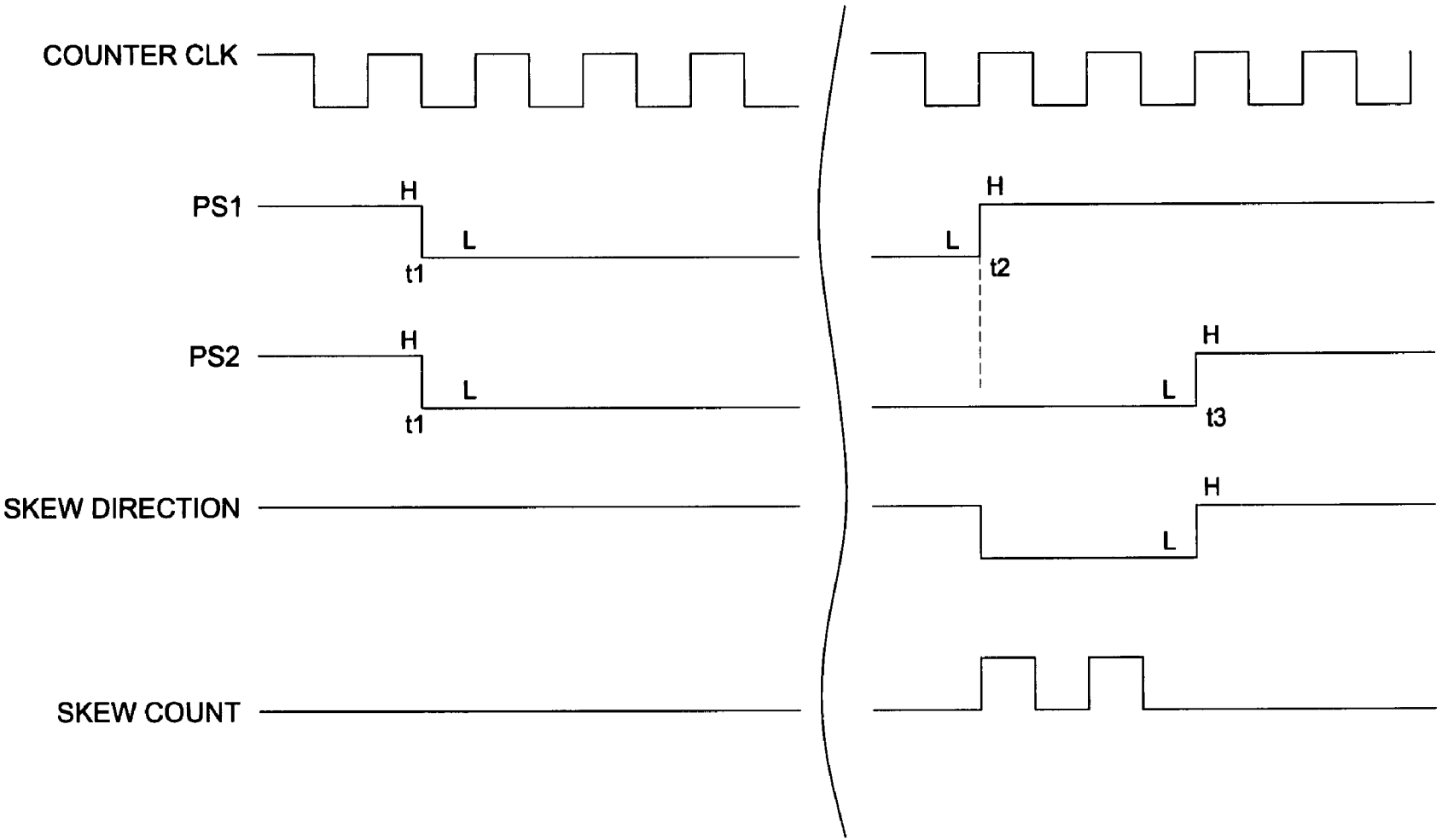
FIG. 14 is a diagram showing an output wave form of the photodetector.

Next, structures of the image forming apparatus relating to the fifth embodiment of the invention will be explained as follows, referring to FIG. 12-FIG. 14. FIG. 12 is a block diagram showing a structure of the image forming apparatus relating to the fifth embodiment of the invention. FIG. 13 is a top view showing an arrangement of a photodetector. FIG. 14 is a diagram showing an output wave form of the photodetector.

In the same way as in the aforesaid first embodiment, the image forming apparatus relating to the fifth embodiment is composed of image reading section 20, sheet-feeding tray 30, sheet supply section 40, image writing section 50, image forming section 60, fixing section 70 and sheet ejection section 80 shown in FIG. 18. In the same way as in the first and second embodiments, the image forming apparatus relating to the fifth embodiment is further composed of system controller 2, correction data storage section 3, drive controller 4, motor M and registration roller 43.

An image forming apparatus relating to the fifth embodiment is equipped with detector PS1 as a first detecting section and detector PS2 as a second detecting section which detect a skew of transfer sheet P, then, it detects a skew of transfer sheet P by detector PS1 and detector PS2 before an image is formed on transfer sheet P, and corrects a skew of transfer sheet P for the conveyance direction based on results of the detection.

Now, an example of arrangement of detectors detecting a skew of transfer sheet P will be explained as follows, referring to FIG. 13. Each of detector PS1 and detector PS2 is composed, for example, of a photo-sensor, and detects transfer sheet P. The detector PS1 and the detector PS2 are arranged, for example, between the registration roller 43 and photoreceptor drum 61. Further, the detector PS1 and the detector PS2 are arranged side by side in the main scanning direction, and a distance between them is distance L. Detector PS3 is composed of an image sensor that detects an edge face of transfer sheet P.

Now, an output waveform of each detector will be explained with reference to FIG. 14. In FIG. 14, counter CLK is a standard clock for detecting a length of transfer sheet P. An output level of each of the detector PS1 and the detector PS2 is ranked into level "L" and level "H" depending on presence of transfer sheet P. For example, when neither detector PS1 nor detector PS2 detects transfer sheet P, the output level is "H", and when they detect transfer sheet P, the output level is "L".

Outputs from the detector PS1 and the detector PS2 make is possible to judge a skew of transfer sheet P from the conveyance direction and a skew of the leading edge or of the trailing edge. For example, when the leading edge of transfer sheet P is perpendicular to the conveyance direction as shown in FIG. 13, namely, when an angle of the skew is "0°", the detector PS1 and the detector PS2 start detecting transfer sheet P simultaneously at time t1. In FIG. 14, an output of the detector PS1 and that of the detector PS2 are changed from level "H" to level "L" simultaneously at time t1.

On the other hand, when the trailing edge of transfer sheet P is skewed from the direction perpendicular to the conveyance direction, as shown in FIG. 13, the detector PS1 and the detector PS2 are different each other in terms of a length of a time period for detecting transfer sheet P. In FIG. 14, the detector PS1 detects transfer sheet P for a time period up to the moment of time t2, while, the detector PS2 detects transfer sheet P for a time period up to the moment of time t3 which is longer than the time period up to time t2. In other words, since the trailing edge is skewed, the detector PS1 and the detector PS2 which are arranged to be away from each other by distance L are different each other in terms of a time period for detecting transfer sheet P. Then, a length of transfer sheet P in the conveyance direction at the position where the detector PS1 is arranged is obtained from a conveyance speed for transfer sheet P and from a length of a time period for the detector PS1 to detect transfer sheet P, and a length of transfer sheet P in the conveyance direction at the position where the detector PS2 is arranged is obtained from a conveyance speed for transfer sheet P and from a length of a time period for the detector PS2 to detect transfer sheet P.

Skew direction signal represents compounded output of an output of the detector PS1 and an output of the detector PS2. When the leading edge or the trailing edge of transfer sheet P is skewed, an output level is "L". In examples shown in FIG. 13 and FIG. 14, there is generated a difference between an output of the detector PS1 and that of the detector PS2 because the trailing edge of transfer sheet P is skewed, and the skew direction signal is on level "L" at the trailing edge.

Results of the detections by the detector PS1 and the detector PS2 are outputted to a calculating section of image processing section 5. The calculation section is composed of length calculating section 5E, skew calculating section 5F and correction amount calculating section 5G, then, a skew of transfer sheet P is obtained based on the results of the detections by the detector PS1 and the detector PS2, and a correction value for correcting the skew is obtained.

After receiving outputs of the detectors PS1 and PS2, the length calculating section 5E obtains a length of transfer sheet P in the conveyance direction at the position where the detector PS1 is installed, from the conveyance speed for transfer sheet P that is set and from a length of a time period through which the transfer sheet P is detected by the detector PS1. Further, the length calculation section 5E obtains a length of transfer sheet P in the conveyance direction at the position where the detector PS2 is installed, from the conveyance speed for transfer sheet P that is set and from a length of a time period through which the transfer sheet P is detected by the detector PS2. For example, when length a represents a length of transfer sheet P in the conveyance direction at the position where the detector PS1 is installed, and length b represents a length of transfer sheet P in the conveyance direction at the position where the detector PS2 is installed, as shown in FIG. 13, the length calculation section 5E obtains length a and length b.

After receiving outputs of the detectors PS1 and PS2, the skew calculating section 5F obtains a skew of transfer sheet P based on the aforesaid outputs. Specifically, the skew calculating section 5F compounds outputs from the detectors PS1 and PS2, and obtains a skew of transfer sheet P from the compounded signals. For example, an output of the detector PS1 and an output of the detector PS2 are compounded as shown in FIG. 14 to obtain signals in the direction of a skew, and when the signal of the skew is on level "L", transfer sheet P is judged to be skewed. In the example, shown in FIG. 14, the trailing edge of transfer sheet P is judged to be skewed. An occasion where the trailing edge of transfer sheet P is skewed will be explained as follows.

Further, the skew calculating section 5F calculates a difference between length a and length b, and that difference is assumed to be skew amount c. Then, the skew calculating section 5F obtains angle $\alpha$ of the trailing edge by using distance L between the detectors and the skew amount c.

Since the relation of tan ($\alpha$)=skew amount c/distance L holds, angle $\alpha=\tan^{-1}$ (skew amount c/distance L) holds.

Further, the skew calculating section 5F judges the direction of skew of the trailing edge depending on the relation in terms of a size between length a and length b.

Further, when detector PS1 and detector PS2 are arranged between the registration roller 43 and photoreceptor drum 61, it is also possible to judge whether the skew of the leading edge of transfer sheet P has been corrected properly by the registration roller 43 or not. In other words, after the leading edge of transfer sheet P hits a nip portion of the registration roller 43, the transfer sheet P is conveyed to photoreceptor drum 61 at prescribed timing. By arranging the detectors PS1 and PS2 between the registration roller 43 and photoreceptor drum 61, it is possible to detect how the transfer sheet P after being subjected to registration processing by the registration roller 43 is skewed.

For example, a difference between the moment when detector PS1 starts detecting transfer sheet P and the moment when detector PS2 starts detecting transfer sheet P corresponds to the skew of the leading edge, and the skew calculating section 5F obtains skew amount d of the leading edge from the conveyance speed for transfer sheet P and from the time difference. On the other hand, when the detector PS1 and the detector PS2 start detecting transfer sheet P simultaneously, the trailing edge of transfer sheet P is judged to be perpendicular to the conveyance direction. For example, as shown in FIG. 14, when the detector PS1 and the detector PS2 start detecting transfer sheet P simultaneously at the moment of time t1, the leading edge of transfer sheet P is judged to be perpendicular to the conveyance direction.

Based on length a, length b and angle $\alpha$, the skew calculating section 5F judges transfer sheet P to be in any one of the state 1-the state 3 shown below.

(State 1)

When length a is equal to length b, and angle $\alpha$ is equal to 0[°], the skew calculating section 5F judges that a shape of transfer sheet P is a rectangle, and the transfer sheet P is conveyed to be in parallel with the conveyance direction. In other words, a judgment is formed that the transfer sheet P itself has no distortion and is conveyed to be in parallel to the conveyance direction.

(State 2)

When length a is equal to length b, and angle α is not equal to 0[°], the skew calculating section 5F judges that transfer sheet P is conveyed obliquely relative to the conveyance direction.

(State 3)

When length a is not equal to length b, and angle α is not equal to 0[°], the skew calculating section 5F judges that transfer sheet P itself has a distortion and transfer sheet P is skewed. In this case, the trailing edge of transfer sheet P is judged to be skewed, because angle α of the trailing edge is not equal to 0.

By using length a and length b of transfer sheet P, distance L between detector PS1 and detector PS2 and constant M determined by the mechanism of the registration roller 43, correction amount calculating section 5G obtains a distance for the registration roller 43 to be moved when fulcrum B serves as an axis. In this case, constant M corresponds, for example, to the distance from fulcrum B to drive source input section A shown in FIG. 3 (*a*). An amount of correction obtained by the correction amount calculating section 5G will be explained later.

Incidentally, though a skew of transfer sheet P is corrected by changing a slant of the registration roller 43 in the fifth embodiment, it is also possible to cause positions of images for the surface and the reverse side to agree each other by changing a position to start writing an image as in the third and fourth embodiments.

(Operations)

Figure 15:
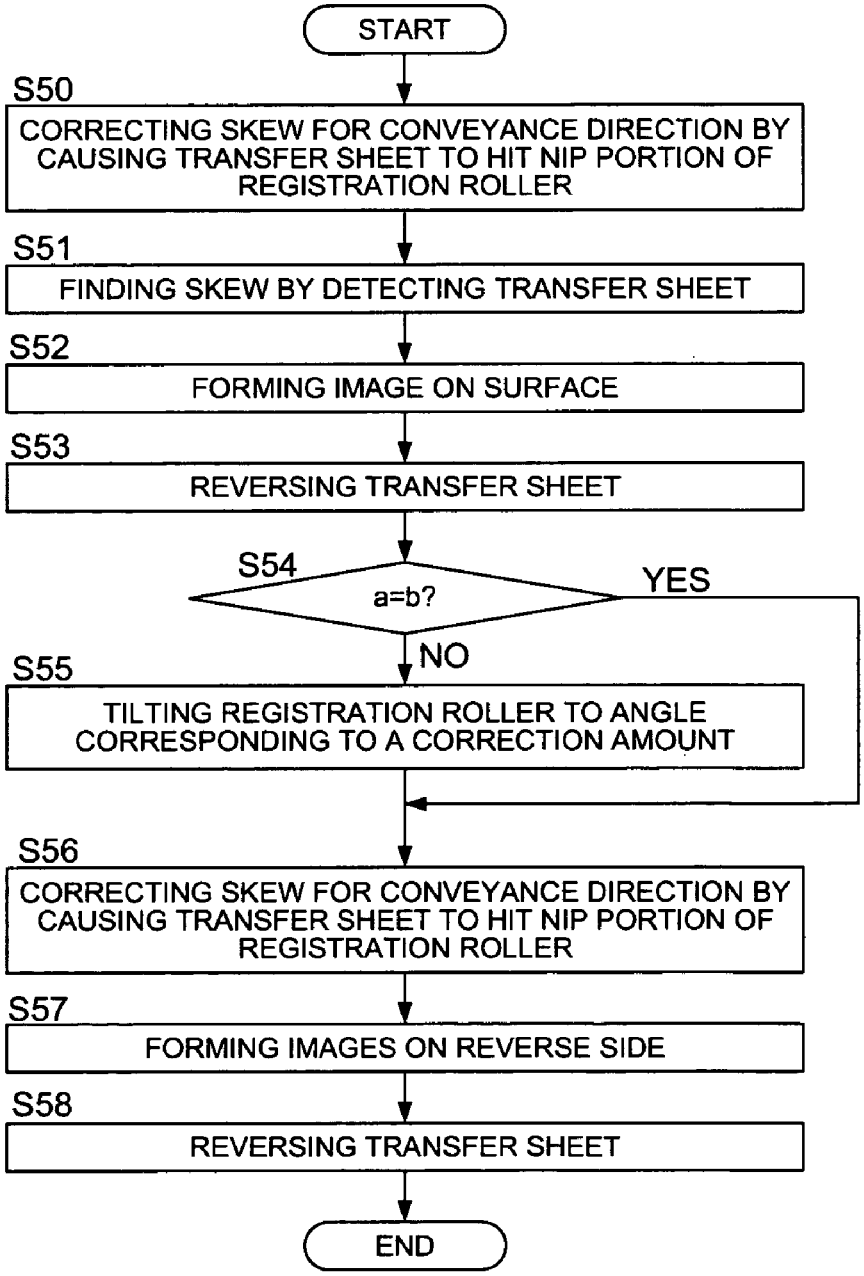
FIG. 15 is a flow chart for illustrating series of operations of an image forming apparatus relating to the fifth embodiment of the invention.
Figure 16:
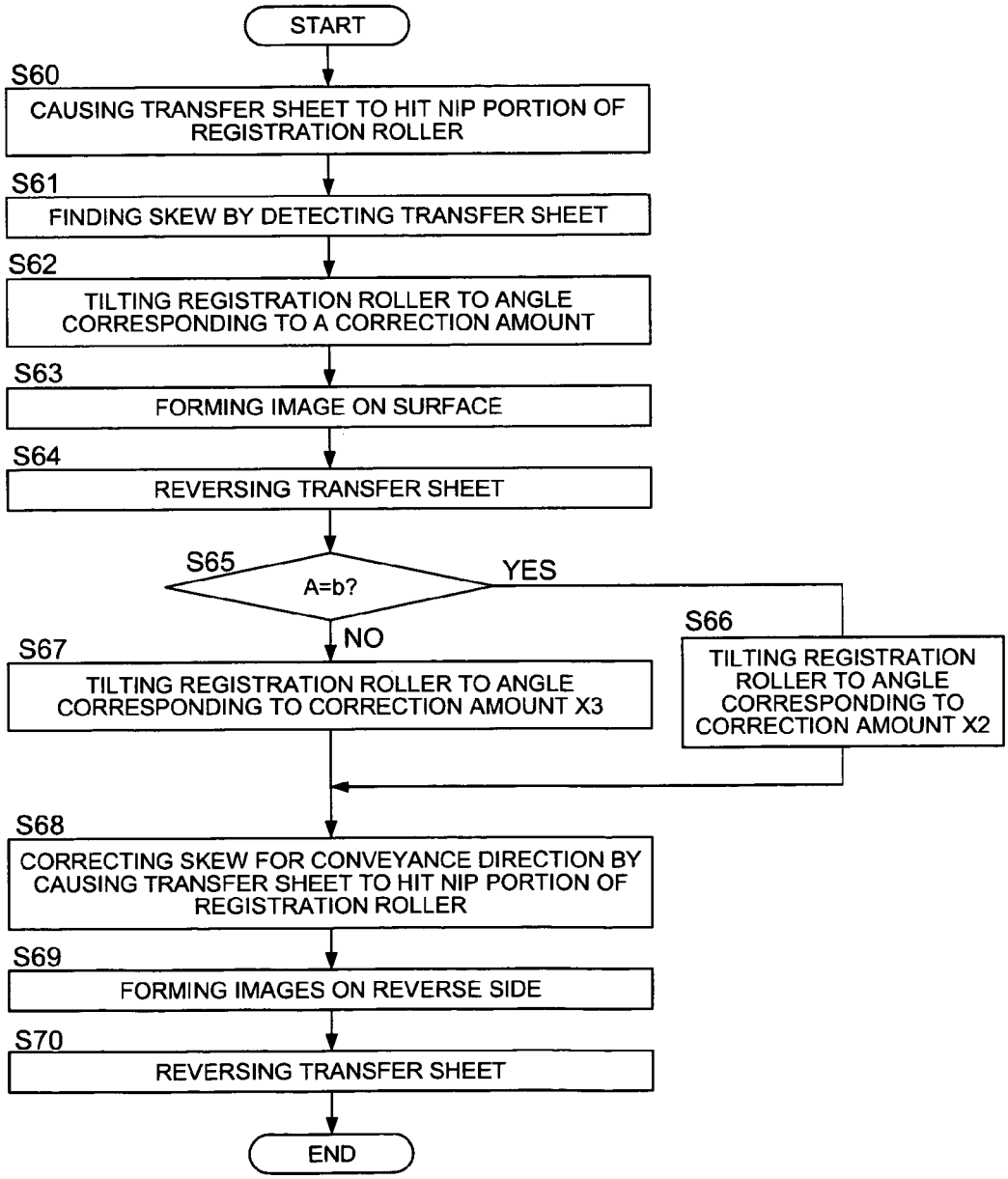
FIG. 16 is a flow chart for illustrating other operations of an image forming apparatus relating to the fifth embodiment of the invention.

Next, operations (image forming method) of an image forming apparatus relating to the fifth embodiment of the invention will be explained as follows, referring to FIGS. 15 and 16. Each of FIGS. 15 and 16 is a flow chart for illustrating a series of operations of an image forming apparatus relating to the fifth embodiment of the invention. Processing in the fifth embodiment is divided into an occasion where the registration processing for the leading edge of transfer sheet P has been carried out normally and an occasion where the registration processing for the leading edge of transfer sheet P is insufficient. First, the occasion where the registration processing for the leading edge has been carried out normally will be explained with reference to FIG. 15, and next, the occasion where the registration processing was insufficient will be explained, referring to FIG. 16.

First, the processing where the registration processing for the leading edge has been carried out normally will be explained with reference to FIG. 15. In this case, detector PS1 and detector PS2 may either be arranged between the registration roller 43 and photoreceptor drum 61, or be arranged on this side of the registration roller 43. In this case, there will be explained an occasion where the detector PS1 and the detector PS2 are arranged between the registration roller 43 and photoreceptor drum 61.

(step S50)

First, for forming an image on the surface of transfer sheet P, a skew of transfer sheet P relative to the conveyance direction is corrected by causing the leading edge of transfer sheet P to hit a nip portion of the registration roller 43. After that, the transfer sheet P is conveyed to photoreceptor drum 61 of image forming section 60 at prescribed timing.

(step S51)

After that, detector PS1 and detector PS2 arranged between the registration roller 43 and photoreceptor drum 61 detect transfer sheet P, and a calculation section obtains a skew of transfer sheet P based on the results of the detection.

The results of the detections by the detectors PS1 and PS2 are outputted to length calculating section 5E. The length calculating section 5E obtains length a of transfer sheet P in the conveyance direction at the position where the detector PS1 is installed, from the conveyance speed of transfer sheet P and from a length of detection time of detector PS1, and further obtains length b of transfer sheet P in the conveyance direction at the position where the detector PS2 is installed, from the conveyance speed of transfer sheet P and from a length of detection time of detector PS2.

After receiving outputs of the detectors PS1 and PS2, skew calculating section 5F compounds the outputs of the detectors PS1 and PS2, and judges a skew of transfer sheet P from the compounded signals. In the examples shown in FIG. 13 and FIG. 14, the leading edge of transfer sheet P is judged to have no skew, and the trailing edge is judged to have a skew.

Further, the skew calculating section 5F calculates a difference between length a and length b, and that difference is made to be skew amount c of the trailing edge. Then, the skew calculating section 5F obtains angle α of the trailing edge by using distance L between detectors and skew amount c. Further, the skew calculating section 5F judges a direction of a skew of the trailing edge by comparing length a with length b.

After receiving skew amount c (=length a−length b of the trailing edge from the skew calculating section 5F, correction amount calculating section 5G uses distance L and constant M to obtain a distance (correction amount X1) through which the registration roller 43 is moved. This correction amount X1 corresponds to the value for correcting a skew (angle α) of the trailing edge. This correction amount X1 is obtained from the following expression (2).

$$\text{Correction amount } X1 : (\text{Length } a - \text{length } b) \times \text{constant } M / \text{distance } L \qquad \text{Expression (2)}$$

Incidentally, correction amount X1 is expressed by the expression (2) above, because the proportional relation of correction amount X1: (length a−length b)=constant M: distance L exists.

(step S52)

Then, in step S52, image forming section 60 forms a toner image on the surface of transfer sheet P, and fixing section 70 fixes the transferred toner image.

(step S53)

Then, for forming an image on the reverse side, the transfer sheet P is conveyed again to image forming section 60 under the condition that the transfer sheet P is reversed by reversing path 84, reversing conveyance roller 85 and reversing conveyance path 86.

(step S54, step S56)

When length a is judged by skew calculating section 5F to be equal to length b (step S54, Yes), a skew of transfer sheet P relative to the conveyance direction is corrected (step S56) by causing transfer sheet P to hit a nip portion of the registration roller 43 without slanting the registration roller 43. Because of the relation of length a=length b, the state of transfer sheet P corresponds to state 1 or state 2. Accordingly, if the state of transfer sheet P is judged by skew calculating section 5F to correspond to state 1 or state 2, a skew of the transfer sheet P relative to the conveyance direction is corrected, without slanting the registration roller 43.

(step S54, step S55, step S56)

On the other hand, when length a is judged by skew calculating section 5F to be different from length b (step S54, No), drive controller 4 causes motor M to rotate to slant the registration roller 43 to angle α (step S55). In this case, drive controller 4 causes motor M to rotate in accordance with correction amount X1 obtained by correction amount calculating section 5G, to slant the registration roller 43 to angle α by swiveling the registration roller 43 by correction amount X1 around fulcrum B representing an axis. After that, transfer sheet P is caused to hit a nip portion of the registration roller 43, to correct a skew of transfer sheet P relative to the conveyance direction (step S56). Because of the relation of length a≠length b, the state of transfer sheet P corresponds to the state 3. Therefore, if the state of transfer sheet P is judged by skew calculating section 5F to correspond to the state 3, a skew of transfer sheet P relative to the conveyance direction is corrected by slanting the registration roller 43 to angle α.

(step S57)

Then, in step S57, image forming section 60 forms a toner image on the reverse side of transfer sheet P, and fixing section 70 fixes the transferred toner image.

(step S58)

The transfer sheet P on which image fixing has been completed on each of the surface and the reverse side, is ejected by sheet-ejection roller 81 onto sheet-ejection tray 82.

In the image forming apparatus relating to the fifth embodiment, as stated above, a skew of the leading edge or the trailing edge of transfer sheet P is detected by using detector PS1 and detector PS2, and an slant of the registration roller 43 is changed based on the aforesaid detected skew to correct a skew of transfer sheet P relative to the conveyance direction, thus, images formed on both surfaces can be aligned in terms of position highly accurately, by canceling positional difference between the image on the surface and the image on the reverse side.

Further, a skew (angle) of transfer sheet P is detected by detector PS1 and detector PS2, and a skew of transfer sheet P is corrected based on the results of the detection, and thereby, positions of images on the surface and on the reverse side can be caused to agree, by correcting a skew of transfer sheet P on a real time basis.

Further, by correcting a skew of each transfer sheet P by detecting a skew (angle) of each transfer sheet P, it is possible to correct a skew of each transfer sheet P even when each transfer sheet P varies slightly in terms of a shape.

Incidentally, it is possible to store information showing a skew (angle) of transfer sheet P detected by detector PS1 and detector PS2 in correction data storage section 3, and thereby to correct a skew of the succeeding transfer sheet P by using a correction value (angle) stored in the correction data storage section 3, when forming an image on the succeeding transfer sheet P.

Next, an occasion where registration processing for the leading edge of transfer sheet P is insufficient will be explained, referring to FIG. 16. In this case, detector PS1 and detector PS2 are arranged between the registration roller 43 and photoreceptor drum 61.

(step S60)

For forming an image on the surface of transfer sheet P, a skew of transfer sheet P relative to the conveyance direction is corrected first, by causing the leading edge of transfer sheet P to hit a nip portion of the registration roller 43. After that, the transfer sheet P is conveyed to photoreceptor drum 61 of image forming section 60 at prescribed timing.

(step S61)

Then, detector PS1 and detector PS2 arranged between the registration roller 43 and photoreceptor drum 61 detect transfer sheet P, and based on the results of this detection, a calculation section obtains a skew of transfer sheet P.

After receiving outputs from detector PS1 and detector PS2, skew calculating section 5F judges whether the leading edge of transfer sheet P is skewed or not, and when it is skewed, its skew amount d is obtained. For example, when the detectors PS1 and PS2 started detecting at the same time, the leading edge of transfer sheet P is judged to be perpendicular to the conveyance direction to be free from a skew. On the other hand, when the time for detector PS1 to start detecting transfer sheet P is different from that for detector PS2 to start detecting transfer sheet P, skew amount d of the leading edge is obtained from a difference of the time and from the conveyance speed for transfer sheet P.

After receiving skew amount d of the leading edge from the skew calculating section 5F, correction amount calculating section 5G uses distance L and constant M to obtain a distance (correction amount X2) through which the registration roller 43 is moved. This correction amount X2 corresponds to the skew of the leading edge. This correction amount X2 is obtained from the following expression (3).

$$\text{Correction amount } X2 = \text{skew amount } d \times \text{constant } M / \text{distance } L \qquad \text{Expression (3)}$$

Incidentally, correction amount X2 is expressed by the expression (3) above, because the proportional relation of correction amount X2: skew amount d=constant M: distance L exists.

(step S62)

Since the leading edge of transfer sheet P is skewed, the skew of the leading edge is corrected by slanting the registration roller 43 while the transfer sheet P is passing through the registration roller 43, for correcting the skew of the leading edge. Drive controller 4 causes motor M to rotate to slant the registration roller 43 (step S62). In this case, the drive controller 4 causes motor M to rotate in accordance with correction amount X2 obtained by correction amount calculating section 5G, to slant the registration roller 43 by moving it.

Further, detector PS1 and detector PS2 keep detecting transfer sheet P while skewing transfer sheet P with the registration roller 43. Results of the detections by the detectors PS1 and PS2 are outputted to length calculating section 5E. The length calculating section 5E obtains length a of transfer sheet P in the conveyance direction at the position where detector PS1 is installed, from the conveyance speed for transfer sheet P and from a length of a time period for detector PS1 to detect, and further obtains length b of transfer sheet P in the conveyance direction at the position where detector PS2 is installed, from the conveyance speed for transfer sheet P and from a length of a time period for detector PS2 to detect.

After receiving outputs of the detectors PS1 and PS2, skew calculating section 5F compounds outputs from the detectors PS1 and PS2, and obtains a skew of the trailing edge of transfer sheet P from the compounded signals.

Correction amount calculating section 5G obtains a correction amount for correcting a skew of the trailing edge. Incidentally, the correction amount for correcting a skew of the trailing edge varies depending on the occasion where length a is equal to length b and the occasion where length a is different from length b.

(step S63)

Then, in step S63, image forming section 60 forms a toner image on the surface of transfer sheet P, and fixing section 70 fixes the transferred toner image.

(step S64)

Then, for forming an image on the reverse side, the transfer sheet P is conveyed again to image forming section 60 under the condition that the transfer sheet P is reversed by reversing path 84, reversing conveyance roller 85 and reversing conveyance path 86.

(step S65, step S66, step S68)

When length a is judged by skew calculating section 5F to be equal to length b (step S65, Yes), drive controller 4 causes motor M to rotate to tilt the registration roller 43 (step S66). In this case, the drive controller 4 causes motor M to rotate in accordance with correction amount X2 obtained by correction amount calculating section 5G, to tilt the registration roller 43 by moving it. In other words, the registration roller 43 is tilted in accordance with an correction amount that is the same as correction amount X2 for correcting the skew of the leading edge. After that, a skew of transfer sheet P relative to the conveyance direction is corrected (step S68) by causing transfer sheet P to hit a nip portion of the registration roller 43.

In the meantime, because of the relation of length a=length b, the state of transfer sheet P corresponds to state 1 or state 2. Accordingly, if the state of transfer sheet P is judged by skew calculating section 5F to correspond to state 1 or state 2, a skew of the transfer sheet P relative to the conveyance direction is corrected, by tilting the registration roller 43 in accordance with correction amount X2.

(step S65, step S67, step S68)

On the other hand, when length a is judged by skew calculating section 5F to be different from length b (step S65, No), the registration roller 43 is tilted in accordance with correction amount X3 obtained by the following expression (4)(step S67).

$$\text{Correction amount } X3 = (\text{length } a - \text{length } b + \text{skew amount } d) \times \text{constant } M / \text{distance } L \qquad \text{Expression (4)}$$

This correction amount X3 is obtained by correction amount calculating section 5G.

When forming an image on the reverse side of transfer sheet P, it is possible to make a positional slippage of an image on the surface and that on the reverse side to offset each other, and thereby, to align images formed on both sides highly accurately, by combining a skew amount of the trailing edge of transfer sheet P and a correction amount for correcting a skew of the leading edge to be correction amount X3 for correcting a skew of the trailing edge.

Drive controller 4 causes motor M to rotate in accordance with correction amount X3 obtained by correction amount calculating section 5G, to tilt the registration roller 43 by moving it. After that, a skew of transfer sheet P relative to the conveyance direction is corrected (step S68) when transfer sheet P is caused to hit a nip portion of the registration roller 43.

Meanwhile, because of the relation of length a≠length b, the state of transfer sheet P corresponds to state 3. Accordingly, if the state of transfer sheet P is judged by skew calculating section 5F to correspond to state 3, a skew of the transfer sheet P relative to the conveyance direction is corrected, by tilting the registration roller 43 to angle α.

(step S69)

Then, in step S69, image forming section 60 forms a toner image on the reverse side of transfer sheet P, and fixing section 70 fixes the transferred toner image.

(step S70)

The transfer sheet P on which image fixing has been completed on each of the surface and the reverse side, is ejected by sheet-ejection roller 81 onto sheet-ejection tray 82.

In the image forming apparatus relating to the fifth embodiment, as stated above, a skew of the leading edge or the trailing edge of transfer sheet P is detected by using detector PS1 and detector PS2, and a slant of the registration roller 43 is changed based on the aforesaid detected skew to correct a skew of transfer sheet P relative to the conveyance direction, thus, images formed on both surfaces can be aligned in terms of position highly accurately, by canceling positional difference between the image on the surface and the image on the reverse side.

Further, a skew (angle) of transfer sheet P is detected by detector PS1 and detector PS2, and a skew of transfer sheet P is corrected based on the results of the detection, and thereby, positions of images on the surface and on the reverse side can be caused to agree, by correcting a skew of transfer sheet P on a real time basis.

Further, by correcting a skew of each transfer sheet P by detecting a skew (angle) of each transfer sheet P, it is possible to correct a skew of each transfer sheet P even when each transfer sheet P varies slightly in terms of a shape.

Further, it is possible to store information showing a skew (angle) of transfer sheet P detected by detector PS1 and detector PS2 in correction data storage section 3, and thereby to correct a skew of the succeeding transfer sheet P by using a correction value (angle) stored in the correction data storage section 3, when forming an image on the succeeding transfer sheet P.

Though a skew of transfer sheet P relative to the conveyance direction was corrected by changing a tilt of the registration roller 43 in the fifth embodiment, it is also possible to change a position to start writing an electrostatic latent image to be formed on photoreceptor drum 61 in accordance with a skew of the leading edge or trailing edge, in the same way as in the third and fourth embodiments. Even when a position to start writing an image is changed in accordance with a skew of the leading edge or the trailing edge as stated above, it is still possible to align positions of images formed on both sides with high-precision.

(Variations)

Figure 17:
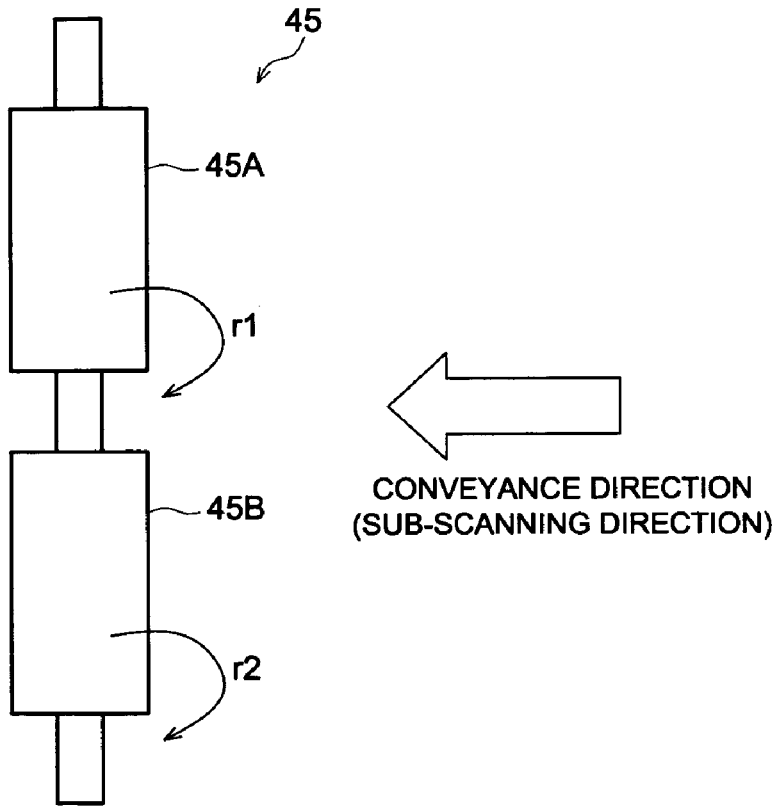
FIG. 17 is a top view showing a schematic structure of a registration roller.

Next, a variation of a registration roller for correcting a skew of transfer sheet P will be explained as follows, referring to FIG. 17. FIG. 17 is a top view showing a schematic structure of a registration roller. In the first-fifth embodiments stated above, the registration roller 43 is tilted or a position to start writing an image is changed to align positions of images formed on the surface and the reverse side. However, in the present invention, it is also possible to align positions of images on the surface and the reverse side, by another means.

For example, registration roller 45 equipped with roller 45A and roller 45B is used as shown in FIG. 17. By making rotation rate r1 of roller 45A to be different from rotation rate r2 of roller 45B, transfer sheet P conveyed by registration roller 45 can be skewed to either direction.

Specifically, when rotation rate r1 of roller 45A is made to be greater than rotation rate r2 of roller 45B, a portion passing through roller 45A on transfer sheet P is conveyed faster than a portion passing through roller 45B, whereby, transfer sheet P is skewed to one direction in the course of passing through registration roller 45. Therefore, it is possible to correct a skew of the leading edge or the trailing edge by skewing transfer sheet P in one direction by changing the rotation rate of roller 45A or roller 45B in accordance with a skew (angle)

of the leading edge and that of the trailing edge of transfer sheet P, which has been used in the aforesaid first-fifth embodiments. The control of rotation rates of roller 45A and roller 45B is carried out by drive controller 4. The drive controller 4 makes rotation rate r1 of roller 45A to be different from rotation rate r2 of roller 45B in accordance with a skew (angle) of the leading edge or the trailing edge. Due to this, transfer sheet P is skewed in either one direction while it is conveyed by registration roller 45, resulting in correction of the skew of the transfer sheet P.

Further, as another variation, it is also possible to arrange so that a skew of the leading edge or the trailing edge of transfer sheet P is corrected when drive controller 4 changes pressure of a conveyance roller other than the registration roller 43 in accordance with a skew of the leading edge or the trailing edge of transfer sheet P.

What is claimed is:

1. An image forming apparatus comprising:

an image forming section for forming images on both sides of a transfer sheet;

a reversing section for reversing the transfer sheet on which an image has been formed on one side thereof;

a first detecting section to detect the transfer sheet being conveyed;

a second detecting section to detect the transfer sheet being conveyed, wherein the second detecting section is arranged to have a predetermined distance from the first detecting section in a direction perpendicular to a conveyance direction;

a calculating section for obtaining:

a skew amount of a leading edge of the transfer sheet based on a moment when the first detecting section starts detecting the transfer sheet and a moment when the second detecting section starts detecting the transfer sheet;

a first length of the transfer sheet at a position where the first detecting section is arranged before reversing the transfer sheet, wherein the first length is obtained based on a result output by the first detecting section;

a second length of the transfer sheet at a position where the second detecting section is arranged before reversing the transfer sheet;

a skew amount of a trailing edge of the transfer sheet based on a difference between the first length of the transfer sheet and the second length of the transfer sheet;

a first correction amount for correcting a skew of the leading edge; and a second correction amount for correcting a skew of the trailing edge; and a correcting section that changes a relative position between the transfer sheet and the image on the one side of the transfer sheet in accordance with the first correction amount obtained by the calculating section, and that further changes a relative position between the transfer sheet and an image on the other side of the transfer sheet in accordance with the second correction amount obtained by the calculating section.

2. The image forming apparatus of claim 1, wherein the correcting section comprises:

a registration roller, arranged in a direction perpendicular to the conveyance direction of the transfer sheet, to correct the skew of the leading edge of the transfer sheet for the conveyance direction by hitting the transfer sheet to the registration roller; and a slanting section which corrects, before the image on the one side of the transfer sheet is formed, the skew of the leading edge of the transfer sheet for the conveyance direction by changing a slant of the registration roller based on the first correction amount obtained by the calculating section, where the first correction amount corresponds to the skew amount, and corrects, before the image on the other side of the transfer sheet is formed, the skew of the trailing edge of the transfer sheet for the conveyance direction by changing the slant of the registration roller based on the second correction amount obtained by the calculating section.

3. The image forming apparatus of claim 1, wherein the correcting section comprises:

a registration roller which is arranged in a direction perpendicular to the conveyance direction of the transfer sheet, and to which the leading edge of the transfer sheet is hit; and a slanting section to slant the registration roller, wherein the first detecting section and the second detecting section detect the transfer sheet before the image on the one side of the transfer sheet is formed and while the registration roller conveys the transfer sheet; and wherein the slanting section, before the image on the one side of the transfer sheet is formed, causes the transfer sheet to hit to the registration roller, then while the registration roller conveys the transfer sheet before the image formation on the one side of the transfer sheet, corrects the skew of the transfer sheet by slanting the registration roller based on the first correction amount obtained by the calculating section, and then before the image on the other side of the transfer sheet is formed, corrects the skew of transfer sheet by slanting the registration roller based on the second correction amount obtained by the calculating section, and then causes the trailing edge of the transfer sheet to hit the registration roller.

4. The image forming apparatus of claim 3, wherein the slanting section corrects, while the registration roller conveys the transfer sheet before the image on the one side of the transfer sheet is formed, the skew of the transfer sheet for the conveyance direction by changing the slant of the registration roller based on the first correction amount obtained by the calculating section, where the first correction amount corresponds to the skew amount of the leading edge of the transfer sheet;

wherein the slanting section changes, before the image on the other side of the transfer sheet is formed, when the first length is equal to the second length, the slant of the registration roller based on the second correction amount obtained by the calculating section, where the second correction amount corresponds to the skew amount of the leading edge of the transfer sheet, and corrects the skew of the transfer sheet for the conveyance direction by causing the trailing edge of the transfer sheet to hit the registration roller; and wherein the slanting section changes, before the image on the other side of the transfer sheet is formed, when the first length is not equal to the second length, the slant of the registration roller based on the second correction amount obtained by the calculating section, where the second correction amount corresponds to a correction amount obtained from the skew amount of the leading edge of the transfer sheet and the skew amount of the trailing edge of the transfer sheet, and corrects the skew of the transfer sheet for the conveyance direction by causing the trailing edge of the transfer sheet to hit the registration roller.

5. The image forming apparatus of claim 1, wherein the correcting section corrects a skew of a subsequently conveyed transfer sheet for the conveying direction based on the first correction amount and the second correction amount.

6. The image forming apparatus of claim 1, wherein the correcting section changes a position to start writing of the image to be formed on the one side of the transfer sheet based on the first correction amount obtained by the calculating section, where the first correction amount corresponds to the skew amount of the leading edge of the transfer sheet, and the correcting section further changes a position to start writing of the image to be formed on the other side of the transfer sheet based on the second correction amount obtained by the calculating section, where the second correction amount corresponds to the skew amount of the trailing edge of the transfer sheet.

7. The image forming apparatus of claim 1, further comprising a registration roller which is arranged in a direction perpendicular to the conveyance direction of the transfer sheet, and to which the leading edge of the sheet is hit;

wherein the first detecting section and the second detecting section detect the transfer sheet while the registration roller conveys the transfer sheet before the image on the one side of the transfer sheet is formed; and wherein the correcting section:

changes a position to start writing of the image to be formed on the one side of the transfer sheet based on the first correction amount obtained by the calculating section, where the first correction amount corresponds to the skew amount of the leading edge of the transfer sheet;

changes a position to start writing of the image to be formed on the other side of the transfer sheet, when the first length is equal to the second length, based on the second correction amount obtained by the calculating section, where the second correction amount corresponds to the skew amount of the leading edge of the transfer sheet; and changes a position to start writing of the image to be formed on the other side of the transfer sheet, when the first length is not equal to the second length, based on the second correction amount obtained by the calculating section, where the second correction amount corresponds to a correction amount obtained from the skew amount of the leading edge of the transfer sheet and the skew amount of the trailing edge of the transfer sheet.

8. The image forming apparatus of claim 1, wherein the correcting section changes respective positions to start writing of an image to be formed on one side and the other side of a subsequently conveyed transfer sheet based on the first correction amount and the second correction amount.

* * * * *